US008147023B2

(12) United States Patent
Hatada et al.

(10) Patent No.: US 8,147,023 B2
(45) Date of Patent: Apr. 3, 2012

(54) PRINTING APPARATUS AND PRINTING METHOD

(75) Inventors: Kenji Hatada, Shiojiri (JP); Hitoshi Igarashi, Shiojiri (JP); Masaki Kobayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 429 days.

(21) Appl. No.: 12/430,315

(22) Filed: Apr. 27, 2009

(65) Prior Publication Data

US 2009/0269119 A1 Oct. 29, 2009

(30) Foreign Application Priority Data

Apr. 25, 2008 (JP) ..... 2008-114921
Aug. 22, 2008 (JP) ..... 2008-214422

(51) Int. Cl.
*B41J 29/38* (2006.01)
*B41J 2/01* (2006.01)

(52) U.S. Cl. ..... 347/16; 347/101; 347/104; 347/105

(58) Field of Classification Search ..... 347/16, 347/101, 104–105
See application file for complete search history.

(56) References Cited

U.S. PATENT DOCUMENTS 4,755,833 A 7/1988 Tanigawa et al.
6,916,132 B2 * 7/2005 Otsuka et al. ..... 400/621
2008/0011805 A1 1/2008 Genta et al.
2008/0239052 A1 * 10/2008 Ishii et al. ..... 347/104

FOREIGN PATENT DOCUMENTS

| | | | |
|---|---|---|---|
| EP | 1044820 | A1 | 10/2000 |
| JP | 2172777 | A | 7/1990 |
| JP | 2003-048351 | | 2/2003 |
| JP | 2003-079177 | | 3/2003 |
| JP | 2006-240212 | | 9/2006 |
| JP | 2007-290866 | | 11/2007 |
| WO | WO-2007030854 | A1 | 3/2007 |

OTHER PUBLICATIONS

European search report, Jul. 7, 2009, Seiko Epson Corporation.

* cited by examiner

*Primary Examiner* — Julian Huffman
*Assistant Examiner* — Jason Uhlenhake
(74) *Attorney, Agent, or Firm* — Nutter McClennen & Fish LLP; John J. Penny, Jr.; Christina M. Sperry

(57) ABSTRACT

A printing apparatus including: a first motor configured to provide a drive force for rotating a roll member that is a wound medium; a second motor configured to provide a drive force for driving a transporting drive roller provided on a downstream side of the roll member along a feeding direction of the medium for transporting the medium; and a control unit configured to drive at least one of the first motor and the second motor to cancel the slackness of the medium generated between the roll member and the transporting drive roller.

7 Claims, 17 Drawing Sheets

PRINTING APPARATUS AND PRINTING METHOD

Priority is claimed to Japanese Patent Applications No. 2008-114921 filed Apr. 25, 2008 and No. 2008-214422 filed Aug. 22, 2008, the disclosures of which, including the specifications, drawings and claims, are incorporated herein by reference in their entireties.

BACKGROUND

1. Technical Field

The present invention relates to a printing apparatus and a printing method.

2. Related Art

Among various ink jet printers, there is a type in which paper of large sizes such as A2 or larger is used. In the ink jet printer for large size paper, a so-called roll paper is used in many cases in addition to cut paper. In the following description, the roll paper, which is paper in a rolled state, is referred to as a "roll member" and a portion pulled out from the roll member is referred to as "paper".

Pulling out of the paper from the roll member is achieved by rotating a transporting roller by a paper feed motor (PF motor). The PF motor is controlled and driven by a PID control.

A printer in which the roll member as described above is used is described in JP-A-2007-290866. Also, a printer that performs the PID control is described in JP-A-2006-240212, JP-A-2003-79177, and JP-A-2003-48351.

Since the transporting roller is generally set apart from the roll member mounted on a printer body by a certain distance in the direction in which the paper is supplied, the paper pulled out from the roll member may slack between the roll member and the transporting roller.

For example, when a printing job is started, a user performs an operation to pull out a paper from the roll member mounted on the printer body and set the same to a paper feed mechanism including the PF motor and the transporting roller. At this time, the paper might slack between the roll member and the paper feed mechanism. After having set the paper in the paper feed mechanism, there is a case where the paper is fed backward (rewound) for accessing a leading edge. In such a case as well, the paper may slack.

When a printing process is performed on the slacked paper, a printed image is distorted, whereby the image quality is deteriorated. Then, normally, the user checks such slackness as needed and, when it is determined that the paper is slacked, the user, for example, rotates the roll member with hand and winds the slacked portion of the paper.

In this manner, in the printer using the roll member, there is a problem such that the user needs to eliminate the slackness of the paper manually, which is a time-consuming job. When the slackness is overlooked, or when the slackness is not sufficiently cancelled, the printed image might be distorted.

SUMMARY

An advantage of some aspects of at least one embodiment of the invention is to provide a printing apparatus and a printing method in which the slackness of a medium such as paper is adequately cancelled.

According to a first aspect of at least one embodiment of the invention, there is provided a printing apparatus including a first motor configured to provide a drive force for rotating a roll member that is a wound medium; a second motor configured to provide a drive force for driving a transporting drive roller provided on a downstream side of the roll member along a feeding direction of the medium for transporting the medium; and a control unit configured to drive at least one of the first motor and the second motor to cancel a slackness of the medium generated between the roll member and the transporting drive roller.

In this configuration, the slackness of the medium generated between the roll member and the transporting drive roller is adequately cancelled.

Preferably, the control unit controls the drive of the first motor so as to provide the drive force for causing the roll member to rotate in a direction opposite from the direction of rotation for transporting the medium in the feeding direction, determines whether or not the slackness of the medium is cancelled and, when it is determined that the slackness of the medium is cancelled, terminates the drive control of the first motor.

In this configuration, the slackness of the medium may be cancelled by rotating the roll member in the opposite direction from the feeding direction.

Preferably, the control unit determines whether or not the slackness of the medium is cancelled on the basis of a control value in PID control with respect to the first motor and a control value in the PID control when transporting the medium at a predetermined velocity.

In this configuration, whether or not the slackness of the medium is cancelled is determined on the basis of the control values, and the slackness of the medium is adequately cancelled.

Preferably, the control unit determines whether or not the slackness of the medium is cancelled on the basis of a total value of control values outputted from a proportional element, an integral element, and a derivative element in PID control with respect to the first motor and a threshold value, which is a control value in the PID control when transporting the medium at a predetermined velocity in a state in which a predetermined tension is provided between the roll member and the transporting drive roller, compares the total value and the threshold value and, when the total value exceeds the threshold value, performs a correction to change the total value to the threshold value and controls the first motor.

In this configuration, when the total value of the control values outputted from the respective elements in the PID control exceed the threshold value, application of a tensile force more than necessary may be prevented by performing the correction to change the total value to the threshold value.

Preferably, the control unit determines whether or not the slackness of the medium is cancelled on the basis of a control value outputted from an integral element in PID control with respect to the first motor and a threshold value, which is a control value in the PID control when the medium is transported at a predetermined velocity in a state in which a predetermined tension is provided between the roll member and the transporting roller, compares the control value and the threshold value and, when the control value exceeds the threshold value, performs a correction to change the control value to the threshold value and controls the first motor.

In this configuration, when the control value outputted from the integral element in the PID control exceeds the threshold value, application of a tensile force more than necessary may be prevented by performing the correction to change the control value to the threshold value.

Preferably, the control unit is configured to control the drive of the second motor so as to provide the drive force to cause the transporting drive roller to rotate in the direction of the rotation for transporting the medium in the feeding direction, and also to detect the movement of the first motor caused by the roll member being pulled via the medium and detect whether or not the slackness of the medium on the basis of the amount of movement of the first motor.

In this configuration, whether or not the slackness of the medium is cancelled is adequately determined on the basis of the movement of the first motor caused by the roll member being pulled.

Preferably, when transporting the medium by the transporting drive roller in the direction opposite from the feeding direction, the control unit activates the first motor to cause the medium to be transported by the roll member in the opposite direction from the feeding direction after having elapsed a predetermined period from the activation of the second motor to cause the medium to be transported by the transporting drive roller in the direction opposite from the feeding direction and when the second motor is still in operation.

In this configuration, when transporting the medium in the direction opposite from the feeding direction, since the transport by the first motor in the opposite direction is started before the transport of the medium by the second motor is completed, the movement of the medium in the opposite direction is completed earlier.

Preferably, when transporting the medium by the transporting drive roller in the direction opposite from the feeding direction, the control unit terminates the drive control of the first motor after the drive control of the second motor is terminated.

In this configuration, since the transport of the medium by the first motor is completed after the completion of the transport of the medium by the second motor, the transport in the opposite direction is completed without generating the slackness of the medium between the roll member and the transporting drive roller.

Preferably, when transporting the medium by the transporting drive roller in the direction opposite from the feeding direction, the control unit controls the first motor and the second motor so as to make the transporting velocity of the medium by the rotation of the roll member to be faster than the transporting velocity of the medium by the rotation of the transporting drive roller.

In this configuration, the transport in the direction opposite from the feeding direction while eliminating the slackness of the medium between the roll member and the transporting drive roller is achieved.

Preferably, the predetermined period is obtained on the basis of the amount of transport of the medium by the transporting drive roller in the direction opposite from the feeding direction, the transporting velocity of the medium by the rotation of the roll member, and the transporting velocity of the medium by the rotation of the transporting drive roller.

In this configuration, the slackness of the medium generated between the roll member and the transporting drive roller is adequately cancelled.

According to a second aspect of at least one embodiment of the invention, there is provided a fluid ejecting apparatus including a first motor configured to provide a drive force for rotating a roll member that is a wound medium; a second motor configured to provide a drive force for driving a transporting drive roller provided on a downstream side of the roll member along a feeding direction of the medium for transporting the medium; a control unit configured to drive at least one of the first motor and the second motor to cancel the slackness of the medium generated between the roll member and the transporting drive roller; and a fluid ejecting head configured to eject fluid to the medium.

In this configuration, the slackness of the medium generated between the roll member and the transporting drive roller is adequately cancelled.

According to a third aspect of at least one embodiment of the invention, there is provided a printing method of a printing apparatus having a first motor configured to provide a drive force for rotating a roll member that is a wound medium and a second motor configured to provide a drive force for driving a transporting drive roller provided on a downstream side of the roll member along a feeding direction of the medium for transporting the medium; including driving at least one of the first motor and the second motor to cancel the slackness of the medium generated between the roll member and the transporting drive roller; and determining whether or not the slackness of the medium generated between the roll member and the transporting drive roller is cancelled.

In this configuration, the slackness of the medium generated between the roll member and the transporting drive roller is adequately cancelled.

Other features of the invention will be apparent by descriptions in the specification and the attached drawings.

BRIEF DESCRIPTION OF THE DRAWINGS

Embodiments of the subject invention are described with reference to the accompanying drawings, where like numbers reference like elements.

DESCRIPTION OF EXEMPLARY EMBODIMENTS

A printer 10 as a printing apparatus and a method of drive control thereof are described below. The printer 10 in the embodiment is a printer configured to print paper having a large size, for example, paper such as A2 size or larger according to JIS standard. Although the printer in the embodiment is an ink jet printer, the ink jet printer may employ any discharging method as long as it is an apparatus that is able to print by discharging ink.

In the description given below, the term "lower side" means the side in which the printer 10 is installed, and the term "upper side" means the side apart from the side to be installed. Also, in the description, the side from which a paper P is fed is referred to as the feeding side (rear end side) and the side from which the paper P is discharged is referred to as the paper-discharging side (near side).

Figure 1:
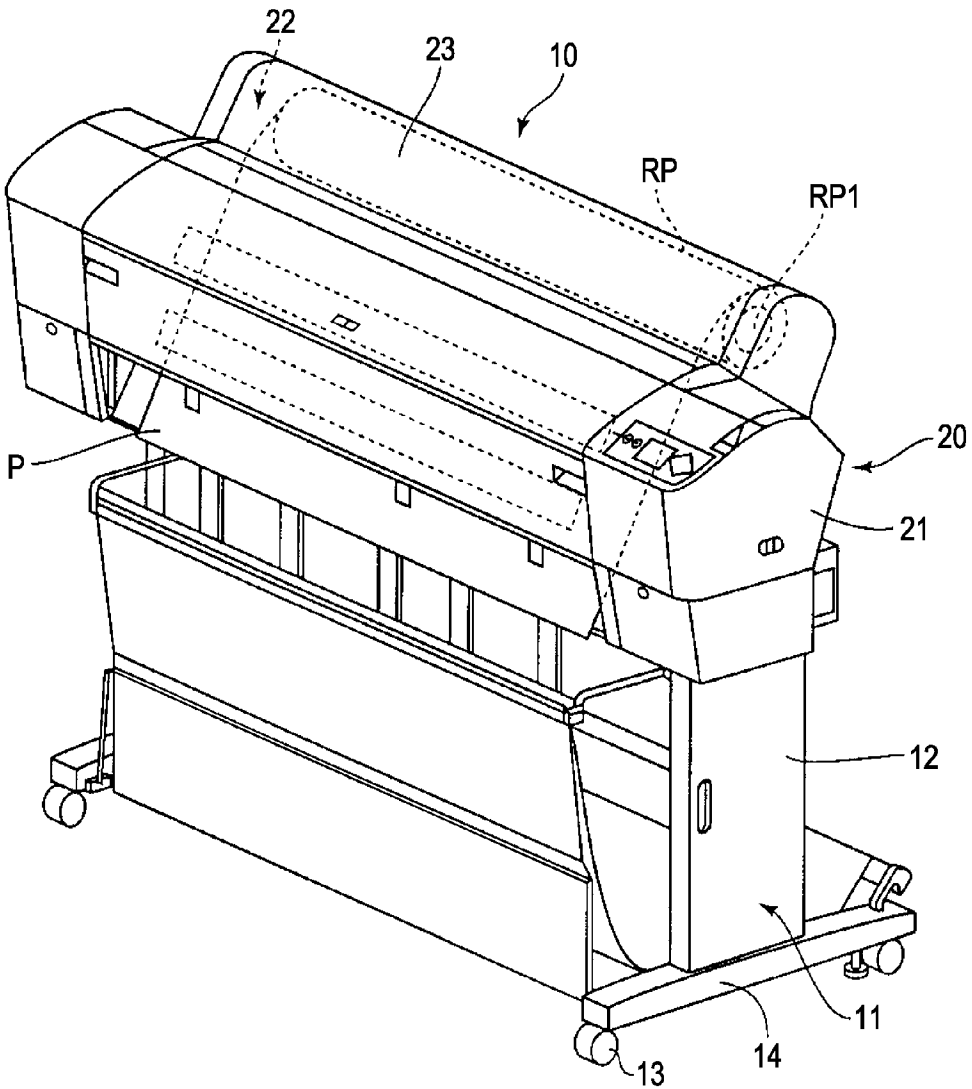
FIG. 1 is a perspective drawing showing a configuration of a printer according to an embodiment.
Figure 2:
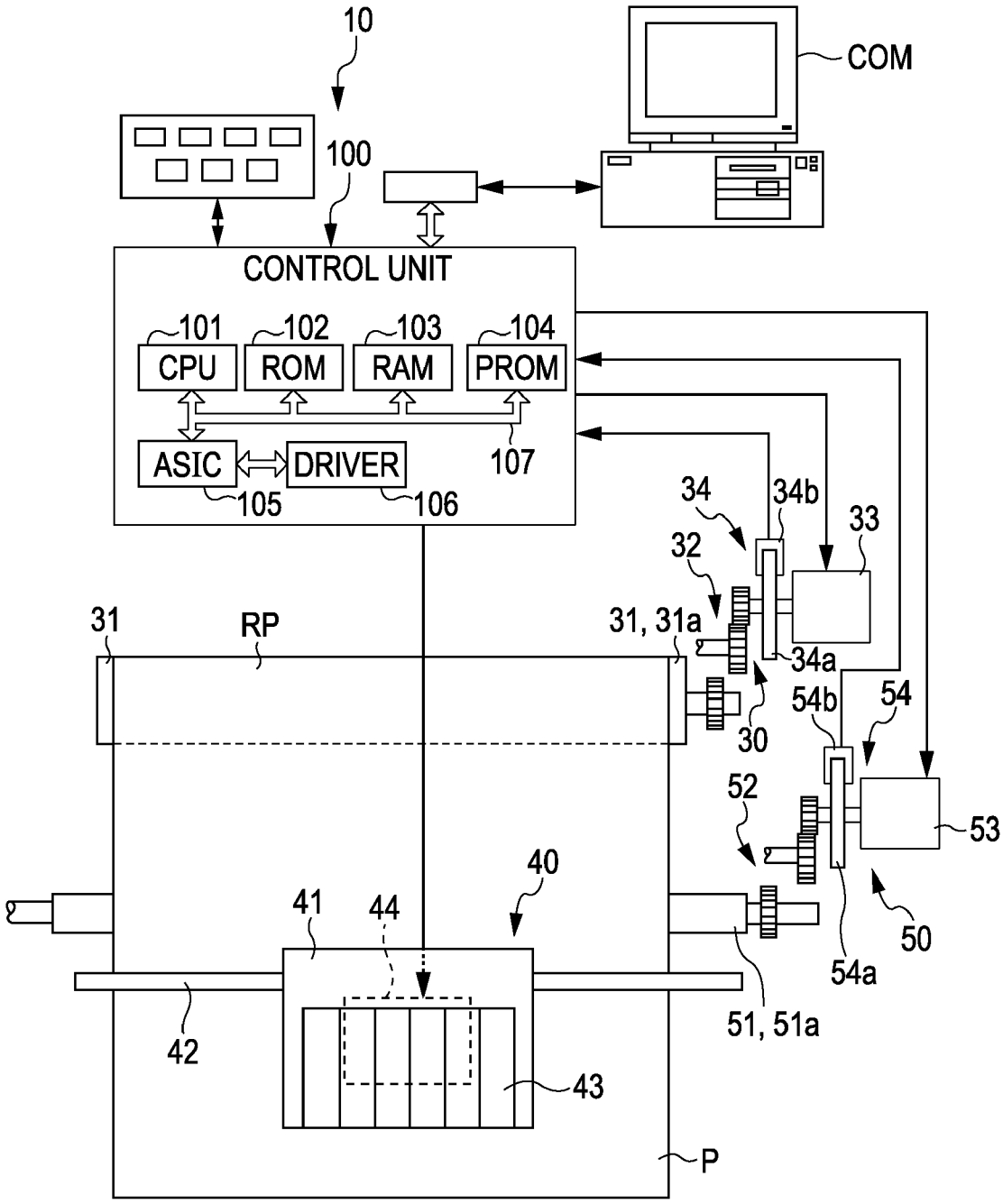
FIG. 2 is a drawing showing a schematic configuration of the printer shown in FIG. 1.

FIG. 1 is a block diagram showing an example of configuration of an appearance of the printer 10 according to an embodiment. FIG. 2 is a drawing showing a relation between a drive system and a control system using a DC motor in the printer 10 shown in FIG. 1.

In this case, the printer 10 includes a pair of leg portions 11 and a body portion 20 supported by the leg portions 11. The leg portions 11 include supporting columns 12 and rotatable casters 13 mounted to caster supporting members 14.

The body portion 20 includes various instruments mounted therein in a state of being supported by a chassis (not shown) and these instruments are covered by an outer case 21. As shown in FIG. 2, the body portion 20 includes a roll drive mechanism 30, a carriage drive mechanism 40, and a paper transporting mechanism 50 as the drive system using the DC motor.

The roll drive mechanism 30 is provided in a roll mounting section 22 disposed in the body portion 20. The roll mounting section 22 is configured to accommodate a roll member RP therein by opening an opening and closing lid 23 provided on the back side and the upper side of the body portion 20 as an element that constitutes the above-described outer case 21 as shown in FIG. 1 and allows rotation of the roll member RP by the roll drive mechanism 30.

Figure 3:
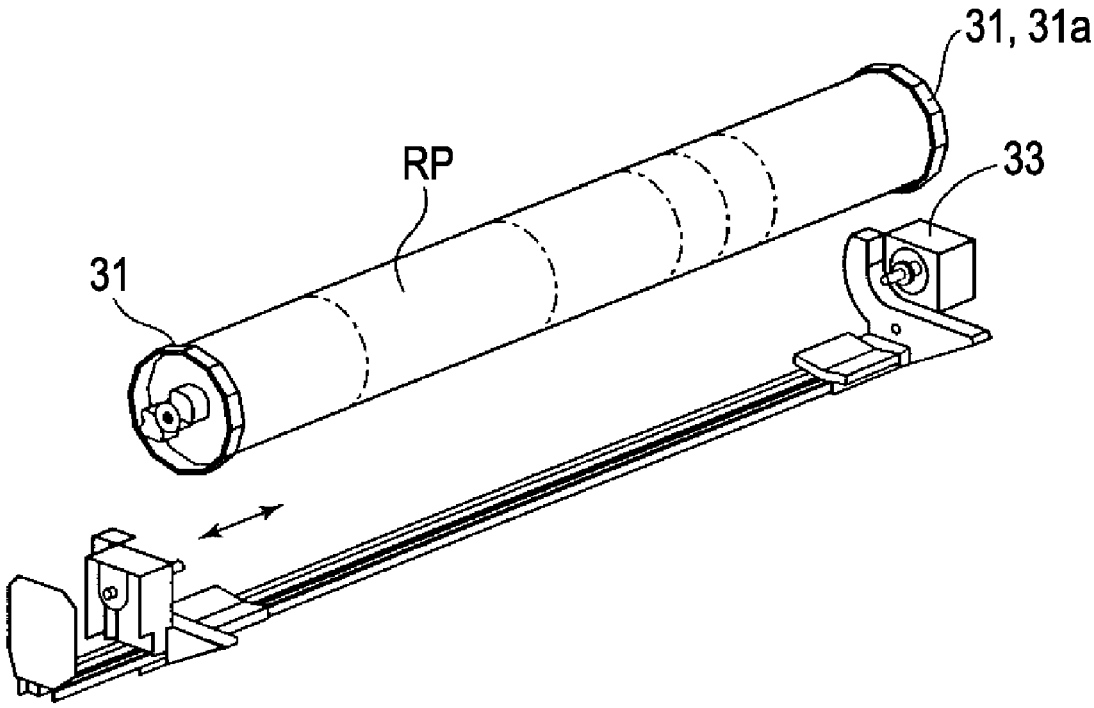
FIG. 3 is a perspective view showing a configuration of rotating holders for holding the roll member.

The roll drive mechanism 30 for rotating the roll member RP includes rotating holders 31, a gear train 32, a roll motor 33, and a rotation detecting unit 34 as shown in FIG. 2 and FIG. 3. FIG. 3 is a drawing showing an example of a configuration of the rotating holder 31 and the roll motor 33.

The rotating holders 31 are configured to be inserted from both end sides of a hollow hole RP1 provided on the roll member RP and are provided in a pair so as to support the roll member RP from the both end sides.

The roll motor 33 as a first motor is configured to provide a drive force (rotational force) to a rotating holder 31*a* positioned on one end side from the pair of rotating holders 31 via the gear train 32.

The rotation detecting unit 34 in the embodiment employs a rotary encoder. Therefore, the rotation detecting unit 34 includes a disk-shaped scale 34*a* and a rotary sensor 34*b*. The disk-shaped scale 34*a* includes light-transmitting portions that allow light to transmit therethrough and light-shielding portions that shield the light arranged at a regular pitch along the circumferential direction thereof. The rotary sensor 34*b* includes a light-emitting element (not shown) a light-receiving element (also not shown) a signal processing circuit (also not shown) as main components.

Figure 4A:
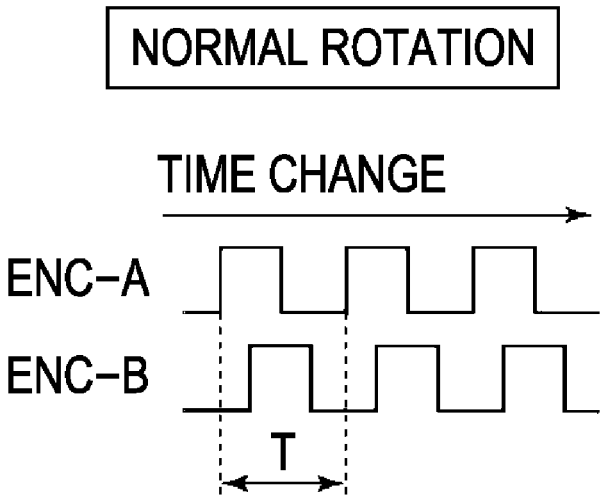
FIG. 4A is a drawing showing ENC signals.
Figure 4B:
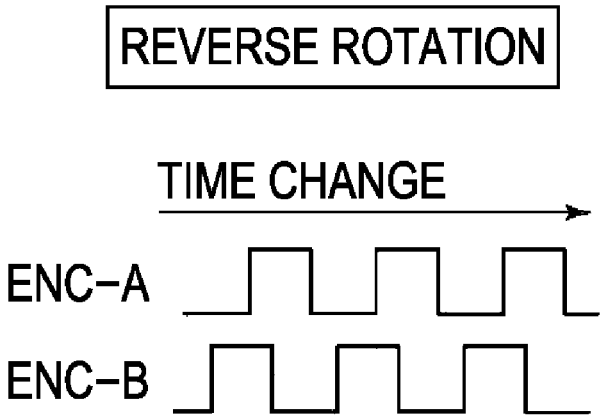
FIG. 4B is a drawing showing ENC signals.

In this embodiment, pulse signals (ENC signals of A-phase and ENC signals of B-phase) having phases different from each other by 90 degrees as shown in FIG. 4 are entered to a control unit 100 by an output from the rotary sensor 34*b*. Therefore, whether the roll motor 33 is in a state of normal rotation or in a state of reverse rotation may be detected according to ahead/delay of the phase.

The body portion 20 is provided with a carriage drive mechanism 40. The carriage drive mechanism 40 includes a carriage 41, a carriage shaft 42, as well as a carriage motor, a belt and so on (not shown) that constitute parts of components of an ink supply/ejection mechanism.

The carriage 41 includes ink tanks 43 for storing ink, which corresponds to fluid, in respective colors, and the ink tanks 43 are configured to allow supply of ink from ink cartridges (not shown) provided fixedly to the front side of the body portion 20 via tubes (not shown). As shown in FIG. 2, a printhead 44, which corresponds to a fluid ejecting head that is able to discharge ink drops is provided on the lower surface of the carriage 41. The printhead 44 is provided with nozzle rows (not shown) corresponding to the ink in respective colors, and nozzles that constitute the nozzle rows are each provided with a piezoelectric element (not shown). With the operation of the piezoelectric elements, ink drops are allowed to be discharged from the nozzles arranged at ends of ink channels.

The carriage 41, the ink tanks 43, the tubes (not shown) the ink cartridges, and the printhead 44 constitute the ink supply/ejection mechanism. The system of the printhead 44 is not limited to a piezoelectric drive system using the piezoelectric elements, and a heater system that heats the ink with a heater and uses the power of generated bubbles, a magneto-striction system using a magnetostrictive element, or a mist system that controls mist with an electric field may also be employed. The ink to be filled in the ink cartridges/ink tanks 43 may be any type such as dye ink/pigment ink, and so on.

Figure 5:
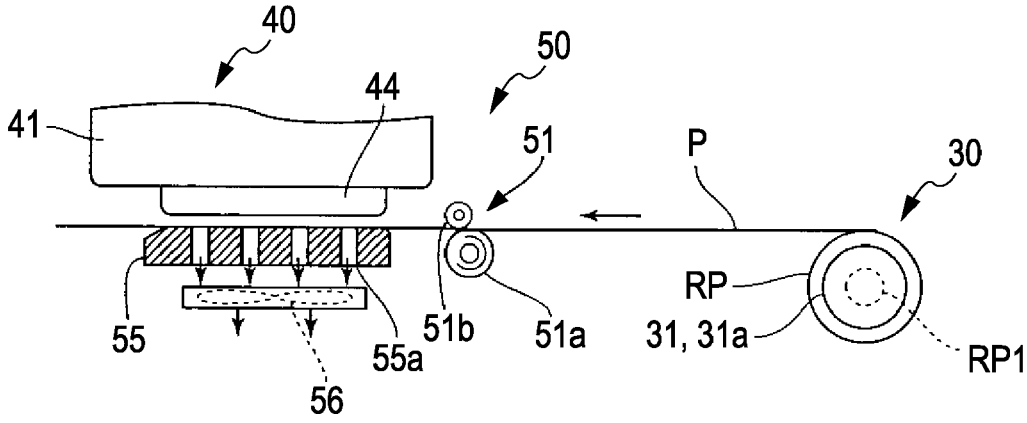
FIG. 5 is a drawing showing a positional relation of the roll member, a transporting roller pair, and a printhead.

As shown in FIG. 2 and FIG. 5, the paper transporting mechanism 50 includes a transporting roller pair 51, a gear train 52, a PF motor 53, and a rotation detecting unit 54. FIG. 5 is a drawing showing a positional relation of the roll member RP, the transporting roller pair 51, and the printhead 44.

The transporting roller pair 51 includes a transporting drive roller 51*a* and a transporting driven roller 51*b*, and the paper P (corresponding to a roll paper) pulled out from the roll member RP can be pinched therebetween.

The PF motor 53 as a second motor is configured to provide a drive force (rotational force) to the transporting drive roller 51*a* via the gear train 52.

The rotation detecting unit 54 in the embodiment employs a rotary encoder, and includes a disk-shaped scale 54*a* and a rotary sensor 54*b* as in the case of the rotation detecting unit 34 described above, and is configured to be able to output pulse signals as shown in FIG. 4.

A platen 55 is provided on the downstream side (paper-discharging side) of the transporting roller pair 51, and the paper P is guided over the platen 55. The printhead 44 is disposed on the platen 55 so as to oppose thereto. The platen 55 is formed with suction holes 55*a*. On the other hand, the suction holes 55*a* are provided so as to be capable of communication with a suction fan 56, so that air is sucked from the printhead 44 side via the suction holes 55*a* by the operation of the suction fan 56. Accordingly, when the paper P is present on the platen 55, the paper P is sucked and held thereon. The printer 10 is additionally provided with various sensors such as a paper-width detection sensor for detecting the width of the paper P.

Figure 6:
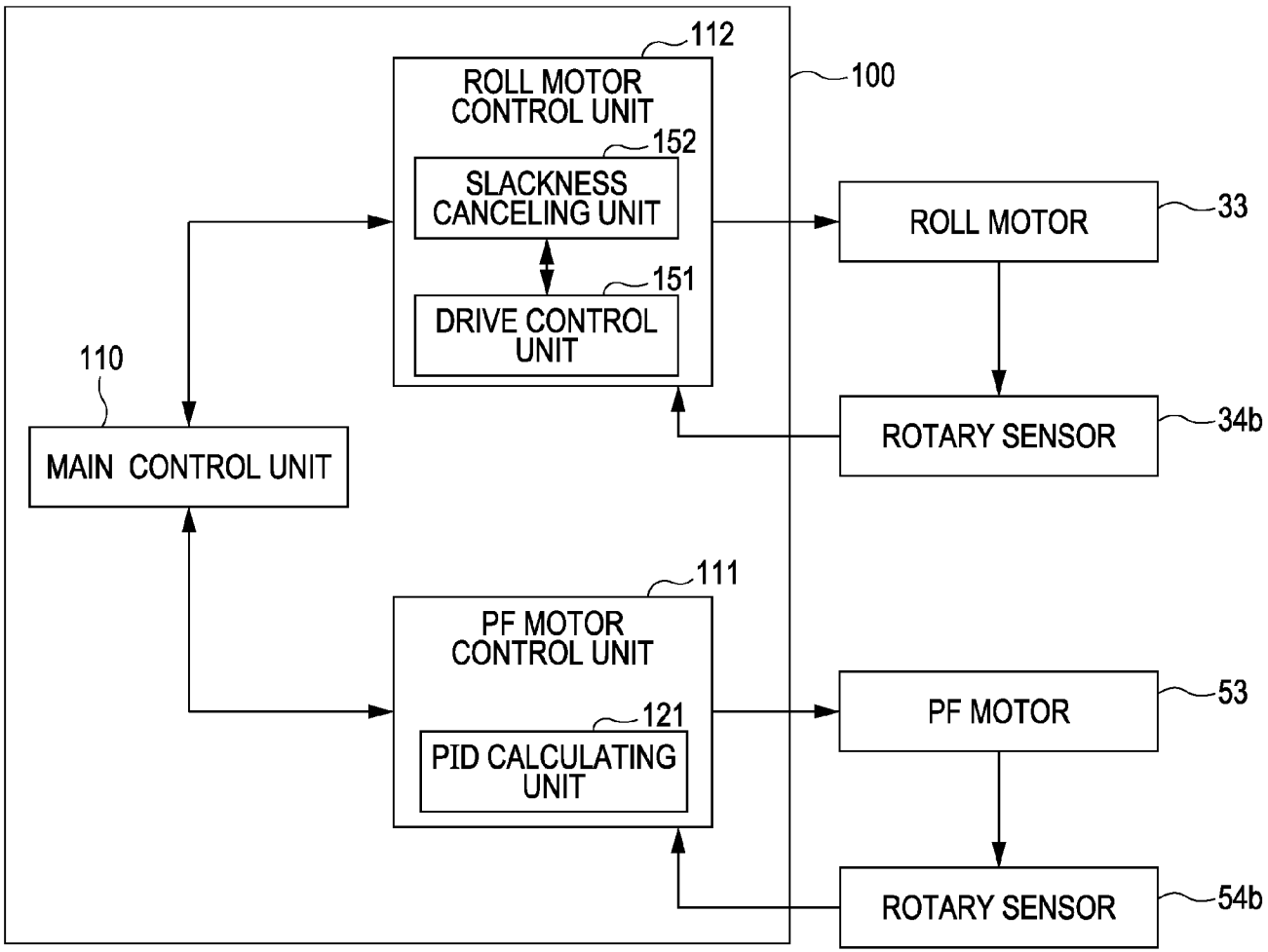
FIG. 6 is a block diagram showing an example of a configuration of a control unit.

FIG. 6 is a block diagram showing a functional configuration of the control unit 100. The control unit 100 receives entries of various output signals from rotary sensors 34*b* and 54*b*, a linear sensor (not shown) the paper-width detection sensor (not shown) a gap detection sensor (not shown) and a power source switch for turning a power source of the printer 10 ON and OFF.

As shown in FIG. 2, the control unit 100 includes a CPU 101, a ROM 102, a RAM 103, a PROM 104, an ASIC 105, and a motor driver 106, which are connected to each other via a transmission path 107 such as a bus. The control unit 100 is connected to a computer COM. Then, a main control unit 110, a PF motor control unit 111, and a roll motor control unit 112 as shown in FIG. 6 are realized by adding circuits or components for achieving cooperation of the pieces of hardware as described above and the software and/or data stored in the ROM 102 and the PROM 104 or performing a specific process.

The PF motor control unit 111 of the control unit 100 controls the drive of the PF motor 53 in such a manner that the paper P is transported in the feeding direction by the rotation of the transporting drive roller 51*a*. In the following description, the direction of rotation of the PF motor 53 when transporting the paper P in the feeding direction is referred to as "direction of normal rotation".

The roll motor control unit 112 controls the drive of the roll motor 33 to cause the roll member RP to rotate and wind the paper P on the roll member RP thereby, so that the slackness of the paper P is cancelled. In the following description, the process to control the drive of the roll motor 33 to cause the roll member RP to rotate to wind the paper P on the roll member RP thereby is referred to as "roll motor slackness canceling process Z1".

The rotation of the roll motor 33 when winding the paper P on the roll member RP is the rotation in the opposite direction from the direction of normal rotation, and this direction is referred to as "direction of reverse rotation".

When the paper P is transported in the feeding direction by the drive of the PF motor 53 for performing the printing job, for example, the roll motor 33 is not conducted with electricity to allow the roll member RP to rotate by being pulled by the paper P and hence rotates in the direction of normal rotation in association with the PF motor 53.

The main control unit 110 controls the operation of the PF motor control unit 111 and the roll motor control unit 112, and causes the same to execute the process to transport the paper P in the feeding direction and the roll motor slackness canceling process Z1.

Subsequently, configurations of the PF motor control unit 111 and the roll motor control unit 112 are described. The PF motor control unit 111 includes a PID calculating unit 121.

Figure 7:
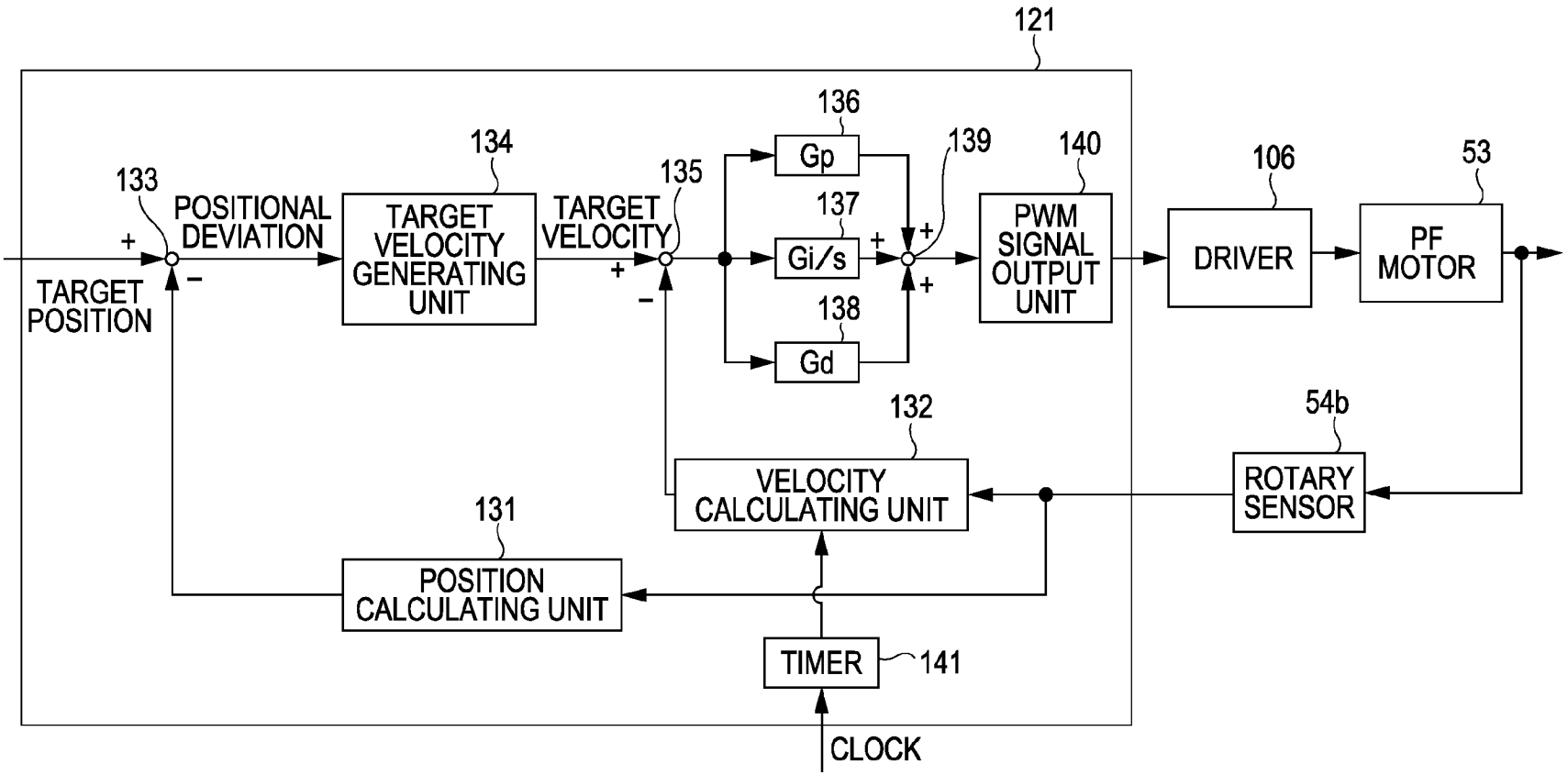
FIG. 7 is a block diagram showing a schematic configuration of a PID calculating unit.

FIG. 7 is a block diagram showing an example of the configuration of the PID calculating unit 121. In the case of this example, the PID calculating unit 121 includes a position calculating unit 131, a velocity calculating unit 132, a first subtracting unit 133, a target velocity generating unit 134, a second subtracting unit 135, a proportional element 136, an integral element 137, a derivative element 138, an adding unit 139, a PWM signal output unit 140, and a timer 141.

The position calculating unit 131 calculates the feeding amount of the paper P by counting edges of output signals as square waves (see FIG. 4) entered from the rotary sensor 54*b*.

The velocity calculating unit 132 counts edges of the output signals as the square waves entered from the rotary sensor 54*b*, and calculates the feeding velocity of the paper P on the basis of the counted edges and the time (cycle) counted by the timer 141, and supplies the result to the second subtracting unit 135.

On the basis of data on the feeding amount (current position) outputted from the position calculating unit 131 and data on a target position (target stop position) outputted from a memory such as the ROM 102 or the PROM 104, the first subtracting unit 133 subtracts the current position from the target position (target stop position) and calculates the positional deviation.

Data on the positional deviation outputted from the first subtracting unit 133 is entered to the target velocity generating unit 134. Then, a target velocity generating unit 134 outputs data on the target velocity according to the positional deviation entered thereto.

The second subtracting unit 135 subtracts the current feeding velocity of the PF motor 53 (current velocity) from the target velocity to calculate a velocity deviation ΔV, and outputs the result to the proportional element 136, the integral element 137, and the derivative element 138, respectively.

The proportional element 136, the integral element 137, and the derivative element 138 respectively calculate a proportional control value QP, an integral control value QI, or a derivative control value QD on the basis of the entered velocity deviation ΔV with expression shown below.

$$QP(j)=\Delta V(j)\times Kp \quad \text{(expression 1)}$$

$$QI(j)=QI(j-1)+\Delta V(j)\times Ki \quad \text{(expression 2)}$$

$$QD(j)=\{\Delta V(j)-\Delta V(j-1)\}\times Kd \quad \text{(expression 3)}$$

where j is the time, Kp is the proportional gain, Ki is an integral gain, and Kd is a derivative gain.

The adding unit 139 adds the proportional control value QP, the integral control value QI, and the derivative control value QD outputted from the proportional element 136, the integral element 137, and the derivative element 138, and outputs a total value obtained thereby (hereinafter, referred to as a control value Qpid) to the PWM signal output unit 140.

The PWM signal output unit 140 outputs a PWM signal of a Duty value obtained by converting the control value Qpid supplied from the adding unit 139.

The timer 141 receives a signal from a clock (not shown). When a predetermined PID calculation cycle such as a cycle of 100 μsec arrives, the timer 141 outputs timer signals to the velocity calculating unit 132 according to the PID calculation cycle.

The motor driver 106 drives the PF motor 53 under the PWM control on the basis of the PWM signal outputted from the PWM signal output unit 140.

Subsequently, a configuration of the roll motor control unit 112 is described. The roll motor control unit 112 includes a drive control unit 151 and a slackness canceling unit 152 as shown in FIG. 6.

The drive control unit 151 executes the roll motor slackness canceling process Z1 (that is, the process to control the drive of the roll motor 33 to cause the roll member RP to rotate to wind the paper P on the roll member RP) according to the control of the slackness canceling unit 152.

Figure 8:
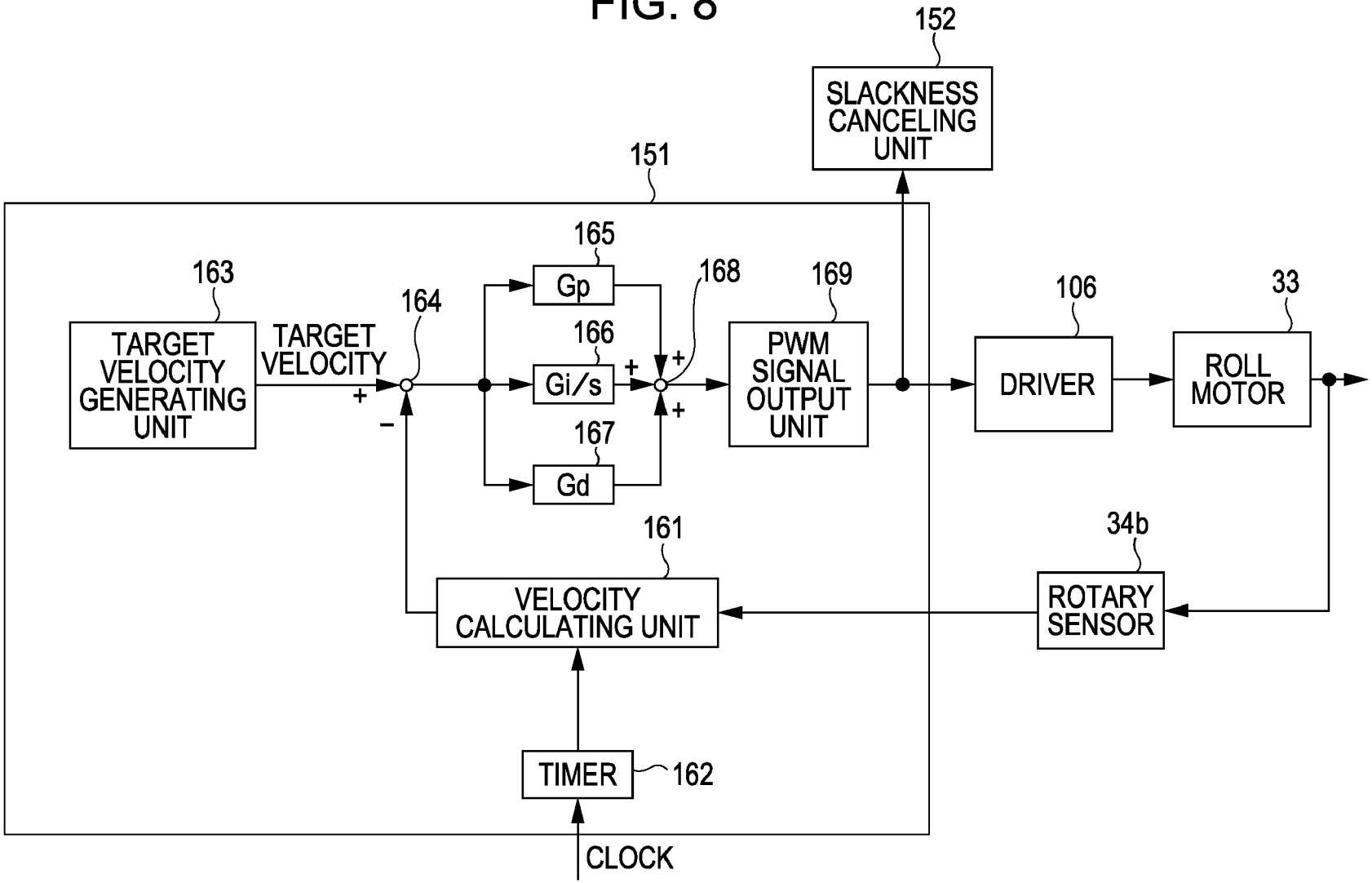
FIG. 8 is a block diagram showing an example of a configuration of a drive control unit.

FIG. 8 is a block diagram showing an example of the configuration of the drive control unit 151 and a relation with respect to the slackness canceling unit 152. In the case of this example, the drive control unit 151 includes a velocity calculating unit 161, a timer 162, a target velocity generating unit 163, a subtracting unit 164, a proportional element 165, an integral element 166, a derivative element 167, an adding unit 168, and a PWM signal output unit 169.

The velocity calculating unit 161 counts edges of the output signals as the square waves entered from the rotary sensor 34*b*, and calculates the current winding feeding velocity of the paper P on the basis of the counted edges and the time (cycle) counted by the timer 162, and supplies the result to the subtracting unit 164.

The timer 162 receives a signal from a clock (not shown). When a predetermined PID calculation cycle such as a cycle of 100 μsec arrives, the timer 162 outputs timer signals to the velocity calculating unit 161 according to the PID calculation cycle.

The target velocity generating unit 163 outputs data showing the target winding velocity of the paper P.

The subtracting unit 164 subtracts the current winding feeding velocity (current velocity) from the target velocity to calculate the velocity deviation ΔV, and outputs the result to the proportional element 165, the integral element 166, and the derivative element 167, respectively.

The proportional element 165, the integral element 166, and the derivative element 167 respectively calculate the proportional control value QP, the integral control value QI, or the derivative control value QD on the basis of the entered velocity deviation ΔV with the expressions 1, 2, and 3 shown above.

The adding unit 168 adds the proportional control value QP, the integral control value QI, and the derivative control value QD outputted from the proportional element 165, the integral element 166, and the derivative element 167, and outputs the control value Qpid obtained thereby to the PWM signal output unit 169.

The PWM signal output unit 169 outputs a PWM signal of a Duty value obtained by converting the control value Qpid supplied from the adding unit 168 to the motor driver 106 and the slackness canceling unit 152.

The motor driver 106 drives the roll motor 33 under the PWM control on the basis of the PWM signal from the PWM signal output unit 169.

The slackness canceling unit 152 will now be described.

The slackness canceling unit 152 controls the drive control unit 151 according to an instruction from the main control unit 110, for example, and starts the roll motor slackness canceling process Z1.

The slackness canceling unit 152 also determines a timing to terminate the roll motor slackness canceling process Z1 on the basis of the Duty value outputted from the PWM signal output unit 169 of the drive control unit 151 and a threshold value Dy, and terminates the roll motor slackness canceling process Z1 at the corresponding timing.

The threshold value Dy is a value obtained by the following expression.

$$DY = \text{ave } T \times W$$

where ave T is a measurement value obtained by a measurement action for rotating the roll member RP at a predetermined velocity Vn (to measure an output value of the motor when the motor is rotated at a predetermined revolving velocity in order to know the load of the motor) required for driving the roll motor 33 at the velocity Vn.

In the measurement action here, the roll motor 33 is rotated in the direction of normal rotation (that is, in the direction to slack the roll paper) in a state in which the PF motor 53 is not driven, and an average value of the control value outputted from the integral element 166 in the PID control of the drive control unit 151 at that time is calculated as the measurement value.

In the expression, W is a coefficient having a value of 1 or higher.

Figure 9:
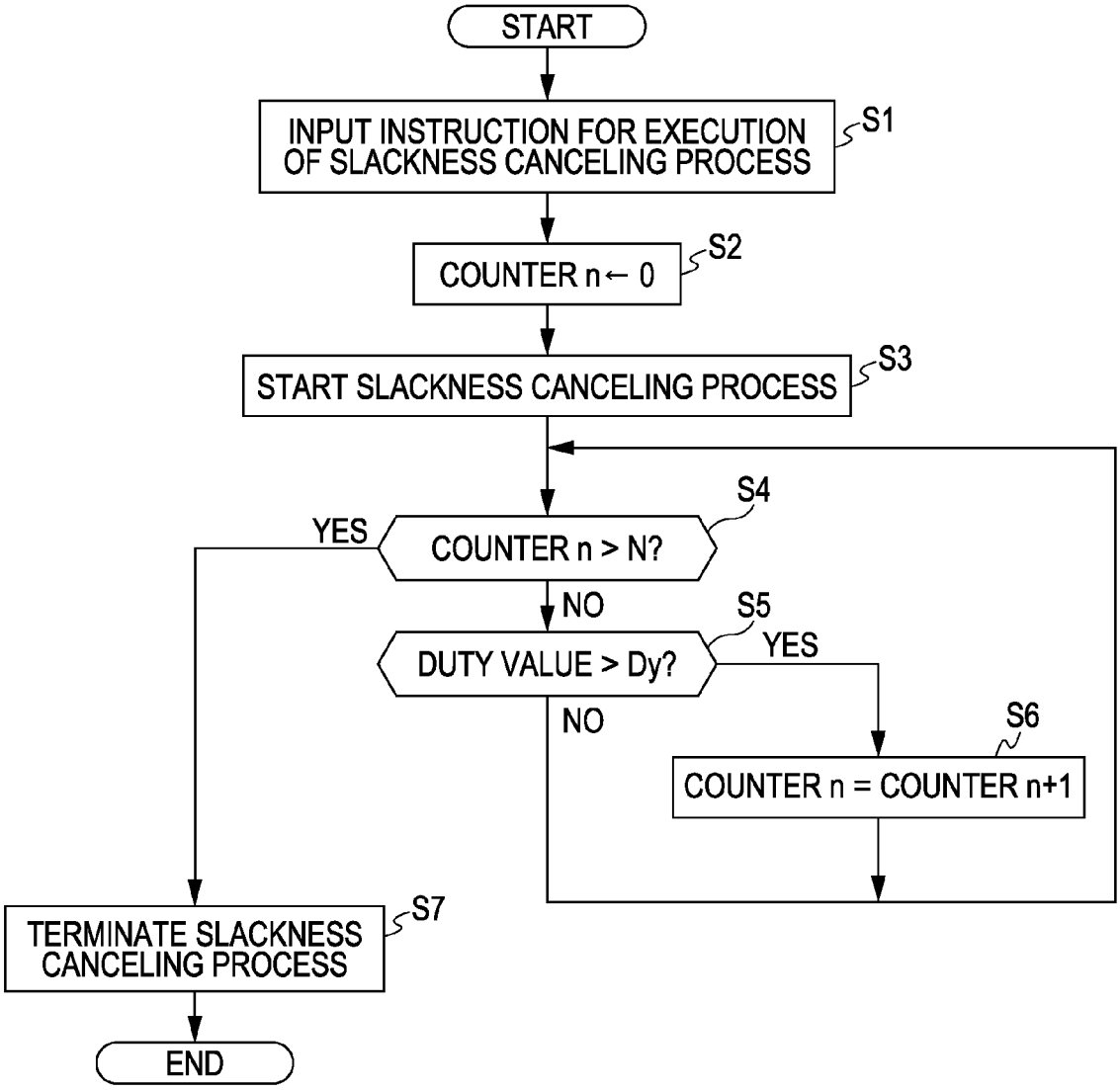
FIG. 9 is a flowchart for explaining an action of a slackness canceling unit in FIG. 8.

FIG. 9 is a flowchart showing a flow of the action of the slackness canceling unit 152. Referring now to this flowchart, the action of the slackness canceling unit 152 is described.

In Step S1, the slackness canceling unit 152 of the roll motor control unit 112 receives an entry of an instruction of execution of the roll motor slackness canceling process Z1 from the main control unit 110. For example, when the roll member RP is mounted on the roll mounting section 22 of the body portion 20, when the printing conditions are changed, or when a predetermined operation such that a predetermined button is pressed by a user is performed, the main control unit 110 senses these actions, and outputs the instruction for execution of the roll motor slackness canceling process Z1 to the roll motor control unit 112. The slackness canceling unit 152 of the roll motor control unit 112 receives an entry of this instruction.

In this manner, when the instruction for execution of the roll motor slackness canceling process Z1 is entered, the slackness canceling unit 152 initializes a value of a counter n to a value 0 in Step S2.

Subsequently, in Step S3, the slackness canceling unit 152 controls the drive control unit 151 to cause the roll motor slackness canceling process Z1 to be started.

In other words, the rotation of the roll motor 33 in the direction of reverse rotation is started so that the respective components (FIG. 8) of the drive control unit 151 are activated, the roll member RP is rotated, and the paper P is wound on the roll member RP. Also, output of the Duty value according to the velocity deviation (V between the target velocity and the current velocity to the slackness canceling unit 152 is started.

Since the PF motor 53 is not driven while the roll motor slackness canceling process Z1 is executed, the transporting drive roller 51*a* is kept standstill, and the paper P is pinched by the transporting roller pair 51.

Subsequently, in Step S4, the slackness canceling unit 152 determines whether the value of the counter n is larger than a predetermined value N or not and, when it is determined not to be large, the procedure goes to Step S5.

In Step S5, the slackness canceling unit 152 compares the Duty value entered from the PWM signal output unit 169 of the drive control unit 151 and the threshold value Dy, and determines whether the Duty value is larger than the threshold value Dy (|Duty value|>threshold value Dy) or not. In other words, whether the Duty value entered from the PWM signal output unit 169 of the drive control unit 151 is larger than the value that is W times the measurement value ave T or not is determined here.

It is assumed that the slackness canceling unit 152 calculates the threshold value Dy on the basis of the measurement value ave T obtained by the measurement action performed at predetermined timing (for example, when the roll member RP is mounted on the roll mounting section 22) and the coefficient W, and holds the threshold value Dy in advance.

When it is determined to be |Duty value|>threshold value Dy in Step S5, the procedure goes to Step S6, and the slackness canceling unit 152 increments the value of the counter n by one.

When it is determined not to be |Duty value|>threshold value Dy in Step S5, or when the value of the counter n is incremented by one in Step S6, the procedure goes back to Step S4, and the process from then onward is performed in the same manner.

When it is determined that the value of the counter n is larger than the predetermined value N in Step S4, the procedure goes to Step S7, and the slackness canceling unit 152 controls the drive control unit 151 and terminates the roll motor slackness canceling process Z1.

The slackness canceling unit 152 acts as described above and the slackness of the paper P is cancelled.

When the winding on the roll member RP is performed in a state in which the slackness of the paper P is cancelled, a tension (tensile force) is applied to the paper P. When the tension is applied to the paper P, the winding velocity tends to be reduced, so that a large Duty value is outputted to accelerate the drive of the roll motor 33 (that is, to achieve the target velocity) in the PID control.

Therefore, when the large Duty value is outputted for a predetermined period, it is determined that the slackness of the paper P is cancelled.

From the principle as described above, since whether the Duty value outputted from the PWM signal output unit 169 of the drive control unit 151 is larger than the value that is W times the measurement value ave T required for driving the roll motor 33 at the predetermined velocity Vn or not is determined (that is, whether or not the large Duty value is outputted is determined) (Step S5), and when the number of times is larger than the predetermined value N (that is, when the large Duty value is outputted for the predetermined period) (Steps S6, S4), it is determined that the slacked portion of the paper P is wound, and the slackness is cancelled, and then the roll motor slackness canceling process Z1 is terminated (Step S7), so that the slackness of the paper P is adequately cancelled.

Figure 10:
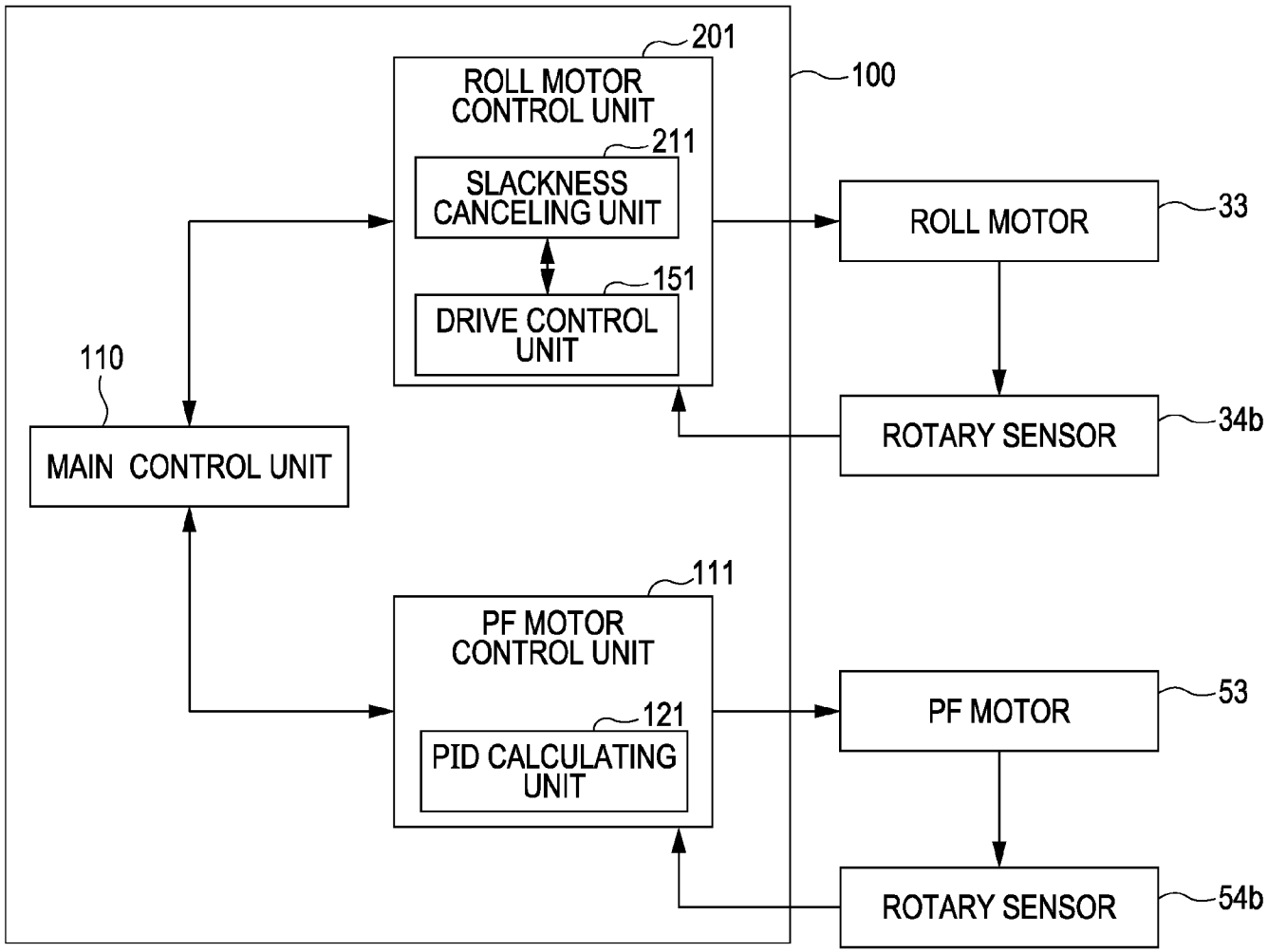
FIG. 10 is a block diagram showing another example of a configuration of the control unit.

FIG. 10 is a block diagram showing another configuration of the control unit 100. The control unit 100 includes a roll motor control unit 201 instead of the roll motor control unit 112 in FIG. 6. Since other portions are the same as in the case of FIG. 6, the description thereof is omitted.

The roll motor control unit 201 is provided with a slackness canceling unit 211 instead of the slackness canceling unit 152 of the roll motor control unit 112 in FIG. 6.

Figure 11:
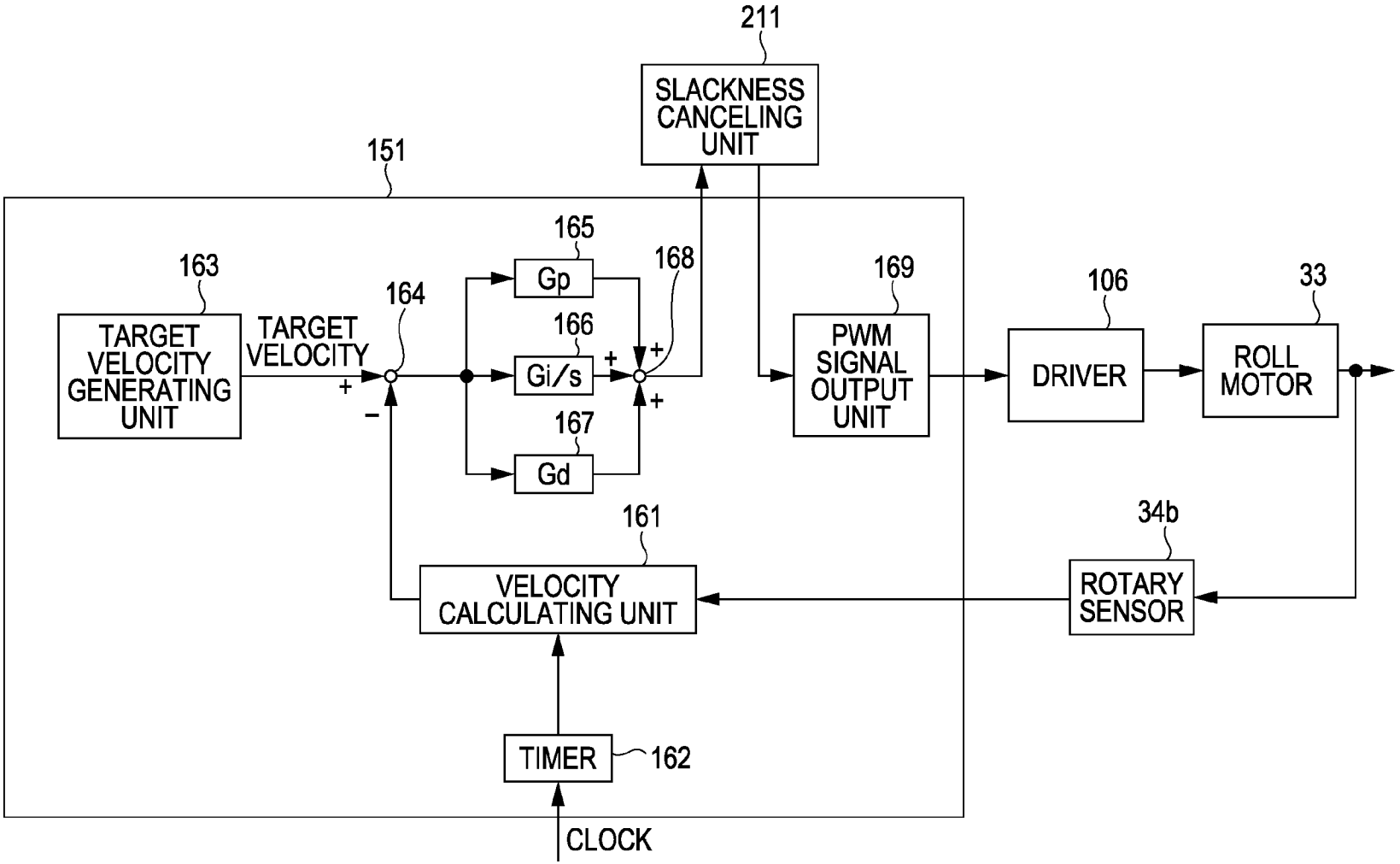
FIG. 11 is a block diagram showing another example of a configuration of the drive control unit.

FIG. 11 is a block diagram showing a relation between the drive control unit 151 and the slackness canceling unit 211 in FIG. 10.

The adding unit 168 adds the proportional control value QP, the integral control value QI, and the derivative control value QD outputted respectively from the proportional element 165, the integral element 166, and the derivative element 167, and outputs the control value Qpid obtained thereby to the slackness canceling unit 211.

The PWM signal output unit 169 receives supply of the control value Qpid or a threshold value Dx, described later, outputted from the slackness canceling unit 211. The PWM signal output unit 169 outputs a PWM signal of a Duty value obtained by converting the control value Qpid supplied from the slackness canceling unit 211 or the threshold value Dx to the motor driver 106.

Since the velocity calculating unit 161 to the subtracting unit 164 act as in the case shown in FIG. 8, the description thereof is omitted.

Subsequently, the slackness canceling unit 211 is described.

The slackness canceling unit 211 controls the drive control unit 151 according to an instruction from the main control unit 110 and starts the roll motor slackness canceling process Z1 in the same manner as the slackness canceling unit 152 in FIG. 6 or FIG. 8.

As described later, the slackness canceling unit 211 also determines a timing to terminate the roll motor slackness canceling process Z1 on the basis of the control value Qpid entered from the adding unit 168 of the drive control unit 151 and the threshold value Dx, and terminates the roll motor slackness canceling process Z1 at the corresponding timing.

The slackness canceling unit 211 further compares the control value Qpid entered from the adding unit 168 of the drive control unit 151 and the threshold value Dx, and supplies the control value Qpid or the threshold value Dx to the PWM signal output unit 169 of the drive control unit 151 on the basis of the result of the comparison.

The threshold value Dx is the Duty value of the roll motor 33 in a case where the paper P is transported at the velocity Vn in a state in which a certain tension F is applied thereto. The threshold value Dx is basically obtained by adding Duty (f) as the Duty value required for applying the tension F (for example, a tension of a predetermined margin that does not break the paper P even when it is applied to the paper P) to the paper P and Duty (ro) as the Duty value required for driving the roll motor 33 at the certain velocity Vn as shown in expression 4.

$$Dx=\mathrm{Duty}(f)+\mathrm{Duty}(ro)=F\times r\times\mathrm{Duty}(\max)/(Kt\times E)+a\,Vn+b \quad \text{(expression 4)}$$

In the expression 4, r is a radius of the roll member RP, Duty (max) is a maximum value of the Duty value, Kt is a motor constant of the roll motor 33, E is a power source voltage value supplied to the roll motor 33. Then, the coefficients a and b are obtained as described below.

Figure 12:
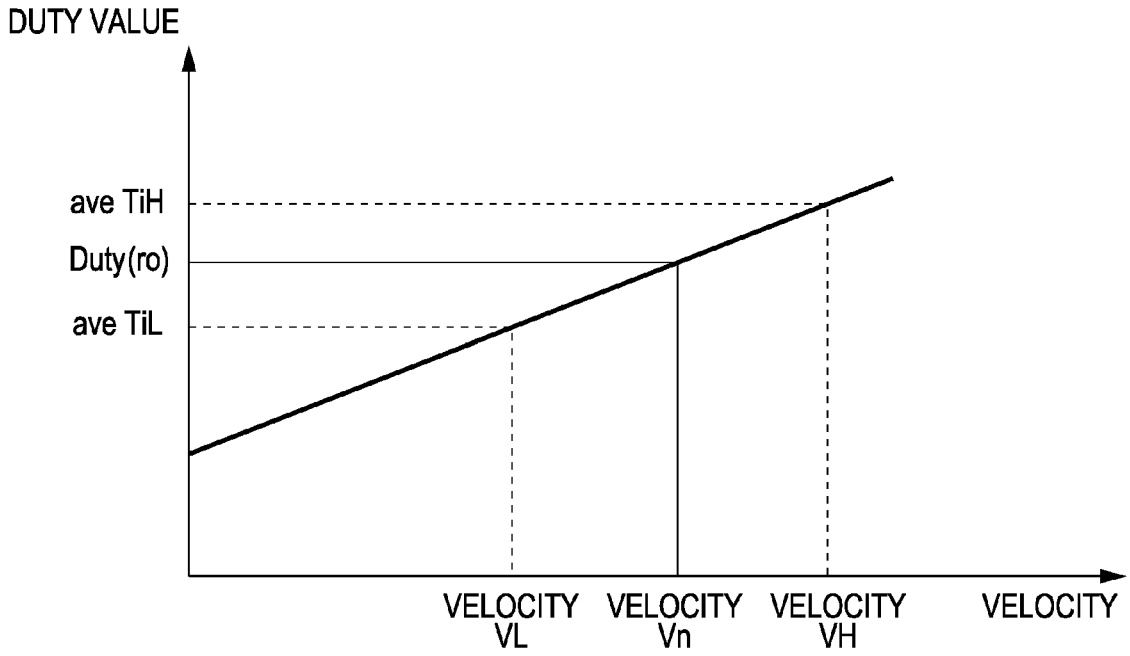
FIG. 12 is a drawing showing a relation between a Duty value and a velocity in a measurement action.

The measurement action is executed for obtaining the Duty value required for driving the roll motor 33 at the certain velocity Vn. In the measurement action, the roll member RP is rotated in the direction of normal rotation at a velocity VL on the low-velocity side and a velocity VH on the high-velocity side as shown in FIG. 12. Then, a measurement value ave TiL required for driving the roll motor 33 at the velocity VL on the low-velocity side and a measurement value ave TiH required for driving the roll motor 33 at the velocity VH on the high-velocity side are calculated respectively. The measurement value ave TiL and the measurement value ave TiH are average values of control values outputted from the integral element 166 of the drive control unit 151 when performing the PID control at the respective velocities.

When the measurement value ave TiL and the measurement value ave TiH are obtained, the relation of a primary expression as shown in FIG. 12 is established. Therefore, the expression 5 is satisfied and the coefficients a and b are obtained by using the measurement value ave TiL and the measurement value ave TiH obtained by the measurement action (expression 6 and expression 7).

$$\mathrm{Duty}(ro)=a\,Vn+b \quad \text{(expression 5)}$$

$$a=(\text{ave } TiH-\text{ave } TiL)/(VH-VL) \quad \text{(expression 6)}$$

$$b=\text{ave } TiH-(\text{ave } TiH-\text{ave } TiL)\times VL/(VH-VL) \quad \text{(expression 7)}$$

The coefficients a and b are obtained in this manner.

The expression 4 is derived as described below.

A case in which the roll motor 33 is driven at the certain velocity Vn and the tension F is applied to the paper P at that time is considered. At this time, a current value Io required for driving the roll motor 33 is obtained by the following expression;

$$Io=(F\times r+Tro)/Kt \quad \text{(expression 8)}$$

where r is the radius of the roll member RP, Tro is a torque required for driving the roll motor 33, and Kt is the motor constant.

Here, the following expression is satisfied from the threshold value Dx that is the Duty value of the roll motor 33, a power source voltage E, an inner resistance R of the roll motor 33, and a back electromotive force constant Ke of the roll motor 33 in the case where the paper P is transported at the velocity Vn in a state in which the tension F is applied.

$$Io=(E\times Dx/\mathrm{Duty}(\max)-KeVn)/R \quad \text{(expression 9)}$$

The torque Tro is obtained from the product of a current value I1 and the motor constant as the following expression, $$Tro=Kt\times I1=Kt\times(E\times\mathrm{Duty}(ro)/\mathrm{Duty}(\max)-Ke\times Vn) \quad \text{(expression 10)}$$

where Tro is the torque required for driving the roll motor 33 at the certain velocity Vn, and Duty (ro) is the Duty value at that time.

The expression 8 and the expression 9 are the same, and when the expression 10 is substituted in Tro in the expression 8 and the both sides are organized, the following expressions are obtained.

$$(F\times r/Kt)+(E\times \mathrm{Duty}(ro)/\mathrm{Duty}(\max)-Ke\times Vn)/R=(E\times Dx/\mathrm{Duty}(\max)-Ke\times Vn)/R$$

$$\therefore Dx=F\times r\times \mathrm{Duty}(\max)/Kt\times E)+\mathrm{Duty}(ro) \quad \text{(expression 11)}$$

$$\mathrm{Duty}(f)=F\times r\times \mathrm{Duty}(\max)/(Kt\times E) \quad \text{(expression 12)}$$

Also from the expression 11 and the expression 5, the Duty value as the threshold value Dx is eventually as follows.

$$Dx=F\times r\times \mathrm{Duty}(\max)/(Kt\times E)+a\ Vn+b \quad \text{(expression 4)}$$

In this manner, the expression 4 is derived.

Figure 13:
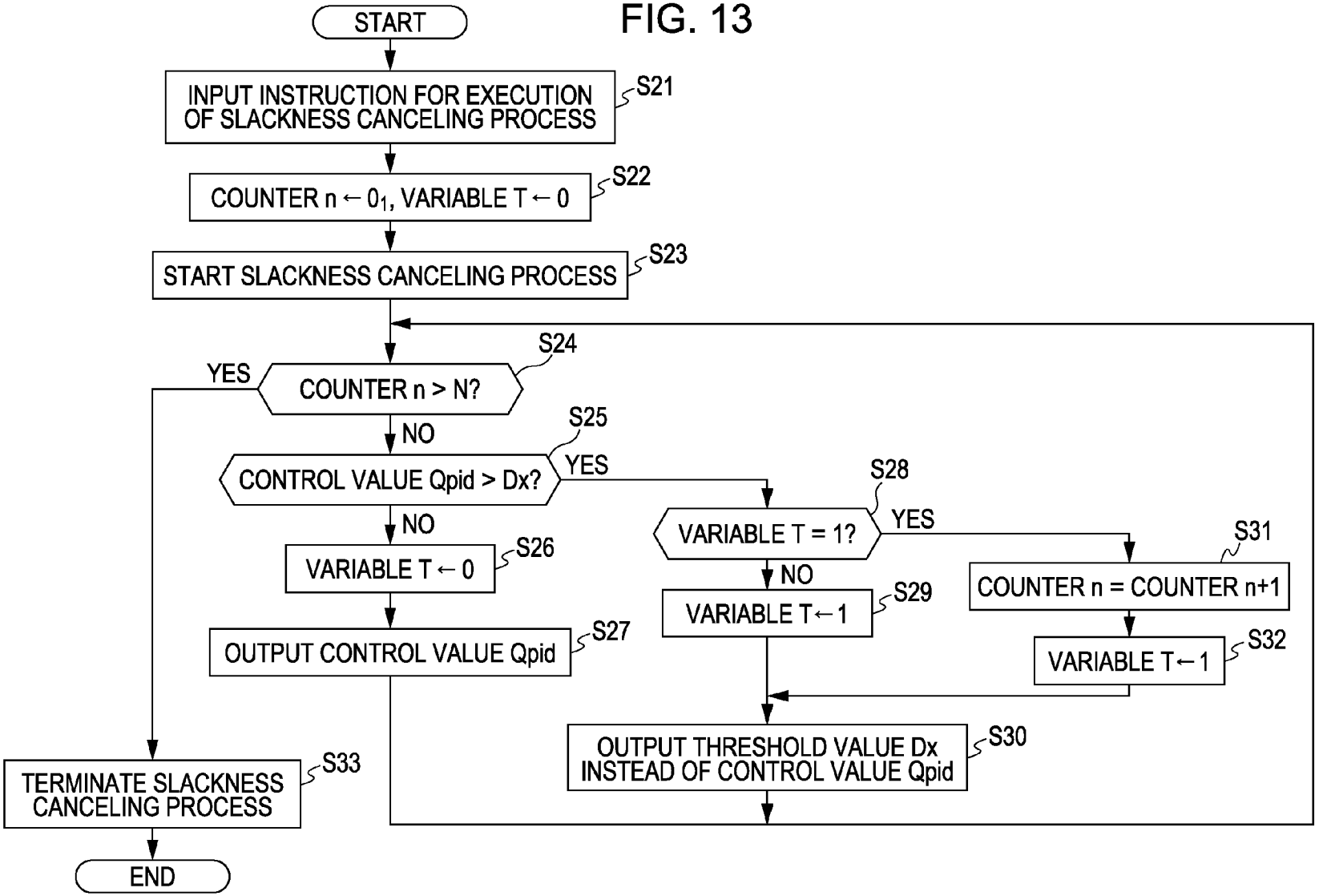
FIG. 13 is a flowchart for explaining an action of a slackness canceling unit in FIG. 11.

FIG. 13 is a flowchart showing a flow of the action of the slackness canceling unit 211. Referring now to this flowchart, the action of the slackness canceling unit 211 is described.

In Step S21 to Step S24, the process that is basically the same as the case of Step S1 to Step S4 in FIG. 9 is executed and hence the description is omitted. In Step S22, the counter n is initialized to a value 0, and a variable T is initialized to a value 0.

In Step S25, the slackness canceling unit 211 compares the control value Qpid entered from the adding unit 168 of the drive control unit 151 and the threshold value Dx calculated as described above and determines whether the control value Qpid is larger than the threshold value Dx (|Qpid|>Dx) or not.

It is assumed that the slackness canceling unit 211 calculates the threshold value Dx on the basis of the coefficients a and b (expression 6, expression 7) obtained from the measurement value ave TiL and the measurement value ave TiH obtained by the above-described measurement actions performed at predetermined timings (expression 4) and holds the same.

When it is determined that |Qpid|>Dx is not satisfied in Step S25, the slackness canceling unit 211 sets the variable T to a value 0 in Step S26.

Then, in Step S27, the slackness canceling unit 211 outputs the control value Qpid entered from the adding unit 168 of the drive control unit 151 to the PWM signal output unit 169 as is.

When it is determined that |Qpid|>Dx is satisfied in Step S25, the procedure goes to Step S28 and the slackness canceling unit 211 determines whether the variable T is the value 1 (variable T=1) or not and, when it is determined not to be the variable T=1, the variable T is set to the value 1 in Step S29.

Then, in Step S30, the slackness canceling unit 211 outputs the threshold value Dx to the PWM signal output unit 169 instead of the control value Qpid entered from the adding unit 168 of the drive control unit 151.

When it is determined to be the variable T=1 in Step S28, the slackness canceling unit 211 increments the value of the counter n by one in Step S31, and sets the variable T to the value 1 in Step S32.

Then, the procedure goes to Step S30, and the slackness canceling unit 211 outputs the threshold value Dx to the PWM signal output unit 169 instead of the control value Qpid entered from the adding unit 168 of the drive control unit 151.

When the control value Qpid or the threshold value Dx is outputted to the PWM signal output unit 169 in Step S27 or Step S30, the slackness canceling unit 211 goes back to Step S24, and executes the process from then onward in the same manner.

When it is determined that the value of the counter n is larger than the predetermined value N in Step S24, the procedure goes to Step S33, and the slackness canceling unit 211 controls the drive control unit 151 and terminates the roll motor slackness canceling process Z1.

The slackness canceling unit 211 acts as described above and the slackness of the paper P is cancelled.

When the winding on the roll member RP is performed in the state in which the slackness of the paper P is cancelled, the tension is applied to the paper P. When the tension is applied to the paper P, the winding velocity tends to be reduced, so that the large control value Qpid for obtaining the large Duty value is outputted to accelerate the drive of the roll motor 33 (that is, to achieve the target velocity) in the PID control.

Therefore, when the large control value Qpid is outputted for a predetermined period, it is determined that the slackness of the paper P is cancelled.

From the principle as described above, since whether the control value Qpid outputted from the adding unit 168 of the drive control unit 151 is larger than the threshold value Dx or not is determined (that is, whether or not the large control value Qpid is outputted is determined) (Step S25), and when the number of times is larger than the predetermined value N (that is, when the large control value Qpid is outputted for a predetermined period) (Steps S24, S31), it is determined that the slacked portion of the paper P is wound, and the slackness is cancelled, and then the roll motor slackness canceling process Z1 is terminated (Step S33), so that the slackness of the paper P is adequately cancelled.

As described above, the control value Qpid is supplied to the PWM signal output unit 169 of the drive control unit 151 when the control value Qpid outputted from the adding unit 168 of the drive control unit 151 is equal to or smaller than the threshold value Dx and the threshold value Dx is supplied thereto when the control value Qpid is larger than the threshold value Dx respectively (Steps S25, S27, and S30), so that the control value equal to or smaller than the threshold value Dx is supplied to the PWM signal output unit 169 (that is, the correction to change the control value Qpid to the threshold value Dx is performed), application of a tension larger than the tension F that breaks the paper P to the paper P when the paper P is wound at the velocity Vn is prevented. That is, the slacked portion of the paper P is wound on the roll member RP without breaking the paper P so that the slackness is cancelled.

In the description described thus far, the slackness canceling unit 211 compares the control value Qpid obtained by adding the proportional control value QP, the integral control value QI, and the derivative control value QD and the threshold value Dx, and controls the roll motor slackness canceling process Z1 on the basis of the result of the comparison. Since the threshold value Dx is a value obtained from the measurement value ave TiL and the measurement value ave TiH as the average values of the integral control values QI outputted from the integral element 166 obtained in the measurement action, comparison of the integral control value QI and the threshold value Dx is also possible.

Figure 14:
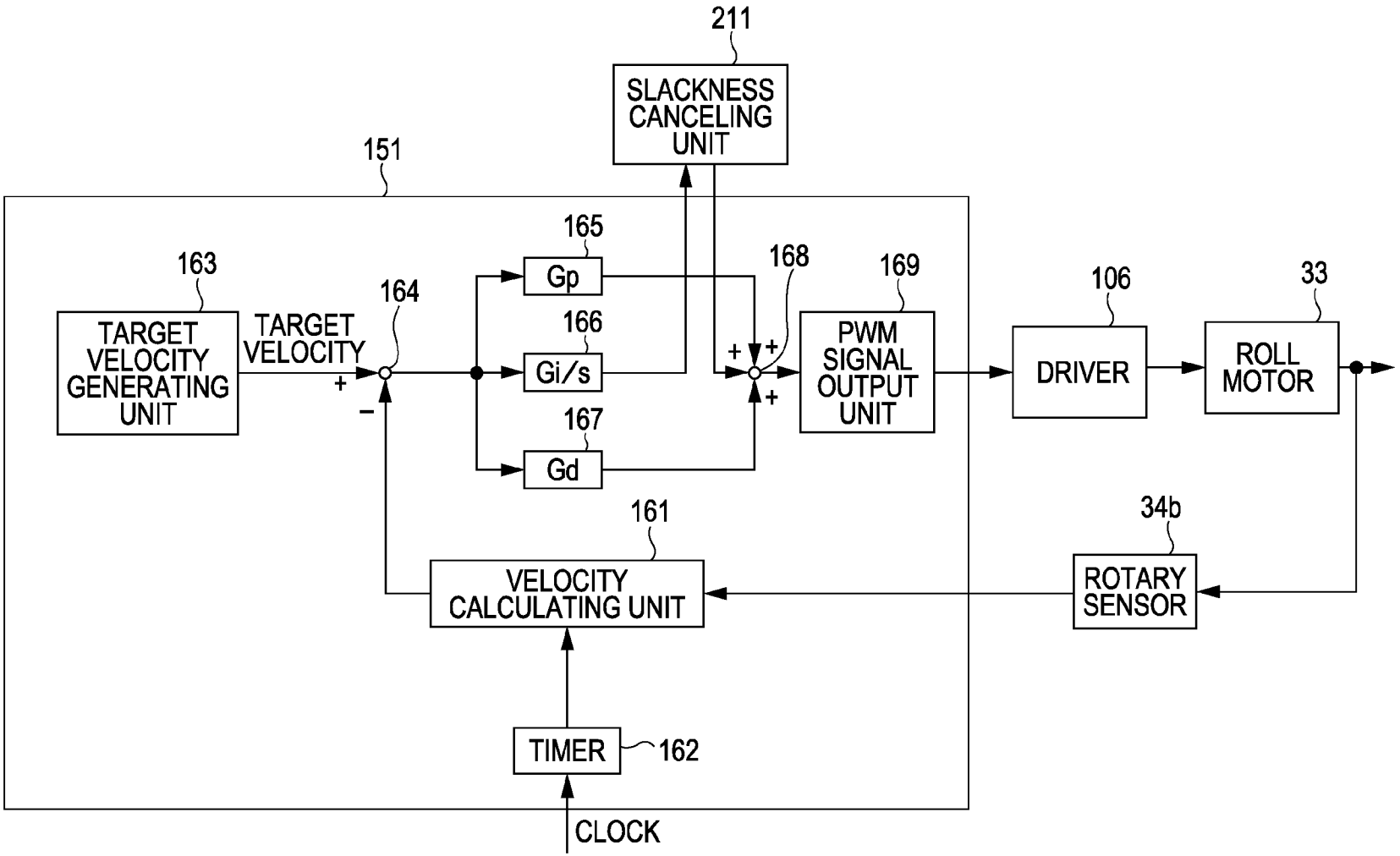
FIG. 14 is a block diagram showing another example of a configuration of the drive control unit.

FIG. 14 is a block diagram showing a relation between an example of the configuration of the drive control unit 151 when controlling the roll motor slackness canceling process Z1 on the basis of the result of the comparison between the integral control value QI and the threshold value Dx and the slackness canceling unit 211.

In the drive control unit 151 shown in FIG. 14, the integral control value QI from the integral element 166 is outputted to the slackness canceling unit 211. The adding unit 168 receives supply of the proportional control value QP and the derivative control value QD outputted from the proportional element 165 and the derivative element 167 and the integral control value QI or the threshold value Dx outputted from the slackness canceling unit 211.

The adding unit 168 adds the proportional control value QP and the derivative control value QD outputted from the proportional element 165 and the derivative element 167 and the integral control value QI or the threshold value Dx outputted from the slackness canceling unit 211, and outputs the control value Qpid obtained thereby to the PWM signal output unit 169.

Figure 15:
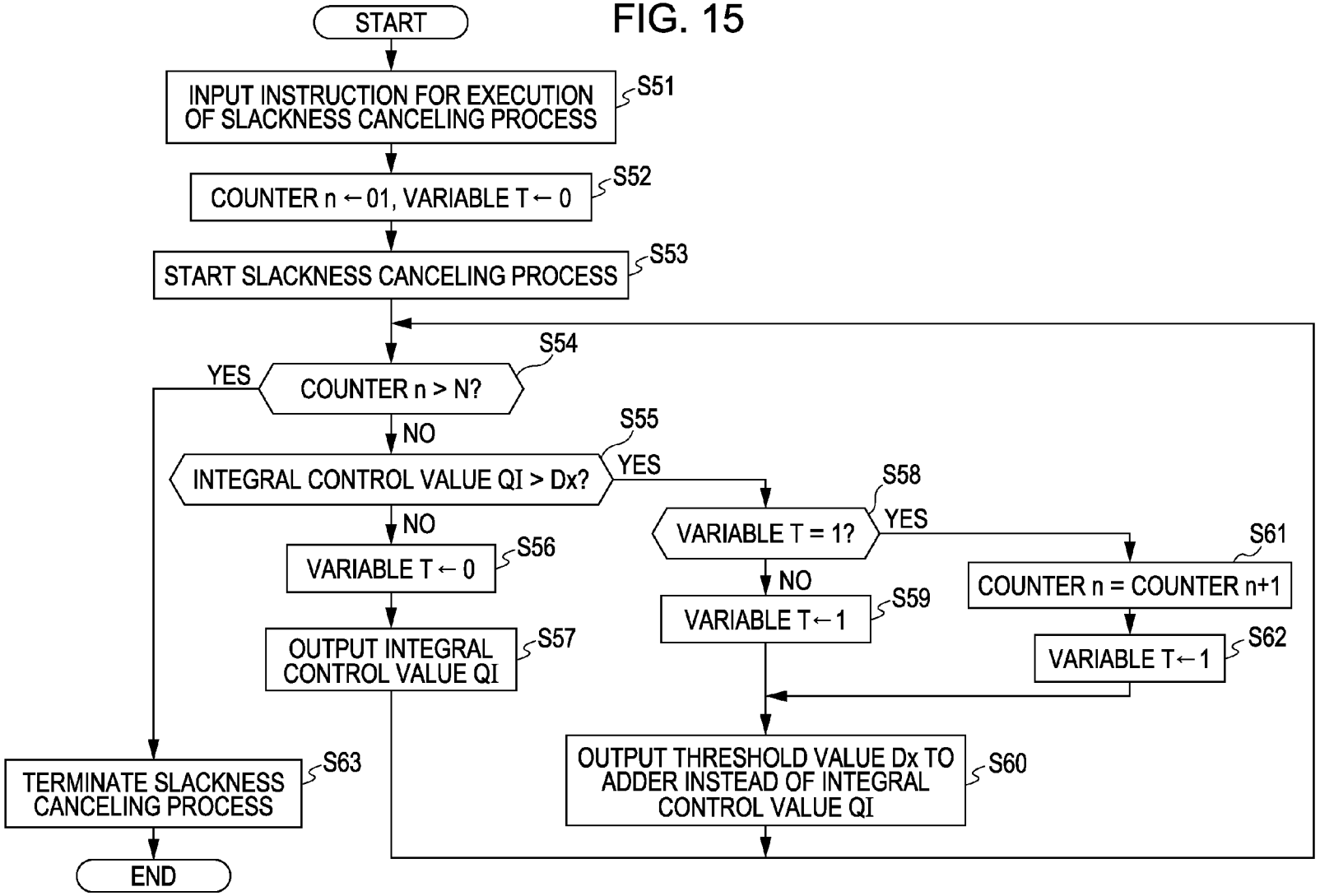
FIG. 15 is a flowchart for explaining the action of the slackness canceling unit in FIG. 14.

FIG. 15 is a flowchart showing a flow of the action of the slackness canceling unit 211 in FIG. 14.

In Step S51 to Step S54, the process that is the same as the case of Step S21 to Step S24 in FIG. 13 is executed and hence the detailed description is omitted.

In Step S55, the slackness canceling unit 211 compares the integral control value QI entered from the integral element 166 an the threshold value Dx, determines whether the relation |QI|>Dx is satisfied or not. If it is determined that the relation |QI|>Dx is not satisfied, the variable T is set to the value 0 in Step S56.

Then, in Step S57, the slackness canceling unit 211 outputs the integral control value QI entered from the integral element 166 to the adding unit 168 as is. In other word, in this case, the adding unit 168 adds the proportional control value QP, the integral control value QI, and the derivative control value QD outputted from the proportional element 165, the slackness canceling unit 211, and the derivative element 167, and outputs the control value Qpid obtained as a result of addition to the PWM signal output unit 169.

When it is determined that |QI|>Dx is satisfied in Step S55, the procedure goes to Step S58, and the slackness canceling unit 211 determines whether the variable T is the value 1 (variable T=1) or not and, when it is determined not to be variable T=1, the variable T is set to the value 1 in Step 59.

Then, in Step S60, the slackness canceling unit 211 outputs the threshold value Dx to the adding unit 168 instead of the integral control value QI entered from the integral element 166 (in other words, a correction to change the integral control value QI to the threshold value Dx is performed). In other words, in this case, the adding unit 168 adds the proportional control value QP, the threshold value Dx, and the derivative control value QD outputted from the proportional element 165, the slackness canceling unit 211, and the derivative element 167, and outputs the control value Qpid obtained threby to the PWM signal output unit 169.

In Step S61 to Step S63, the process that is the same as the case of Step S31 to Step S33 in FIG. 13 is performed and hence the detailed description is omitted.

Figure 16:
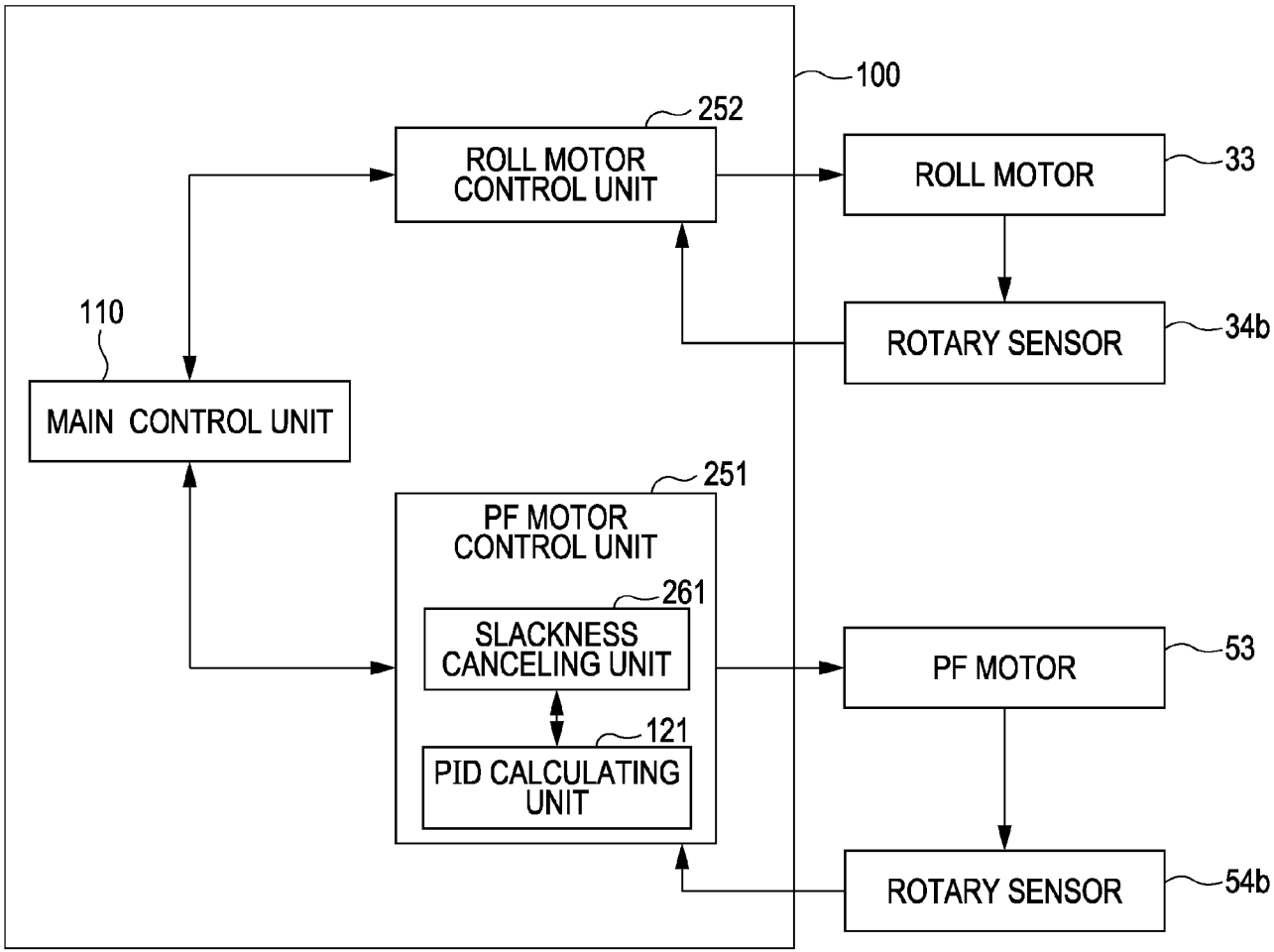
FIG. 16 is a block diagram showing another example of the configuration of the control unit.

FIG. 16 is a block diagram showing another configuration of the control unit 100. The control unit 100 includes a PF motor control unit 251 instead of the PF motor control unit 111 of the control unit 100 in FIG. 6 and a roll motor control unit 252 instead of the roll motor control unit 112 or the same.

The PF motor control unit 251 includes the PID calculating unit 121 of the PF motor control unit 111 in FIG. 6 and a slackness canceling unit 261.

The PID calculating unit 121 in FIG. 16 controls the rotation of the PF motor 53 in the direction of normal rotation in such a manner that the paper P is transported in the feeding direction by the rotation of the transporting drive roller 51*a* as in the case shown in FIG. 6.

The PID calculating unit 121 controls the rotation of the PF motor 53 in the direction of normal rotation in such a manner that the paper P is transported in the feeding direction to cancel the slackness of the paper P. In the following description, the process to control the rotation of the PF motor 53 in the direction of normal rotation in such a manner that the paper P is transported in the feeding direction to cancel the slackness of the paper P is referred to as a PF motor slackness canceling process Z2.

The roll motor control unit 252 does not control the drive of the roll motor 33 for eliminating the slackness of the paper P as the roll motor control unit 112 described above and, for example, controls the drive of the roll motor 33 for controlling the tension when the paper P is transported in the feeding direction.

In other words, in the embodiments shown in FIG. 6 and FIG. 10, the slackness of the paper P is cancelled by controlling the drive of the roll motor 33. However, the embodiment shown in FIG. 16 is configured to cancel the slackness of the paper P by controlling the drive of the PF motor 53.

Figure 17:
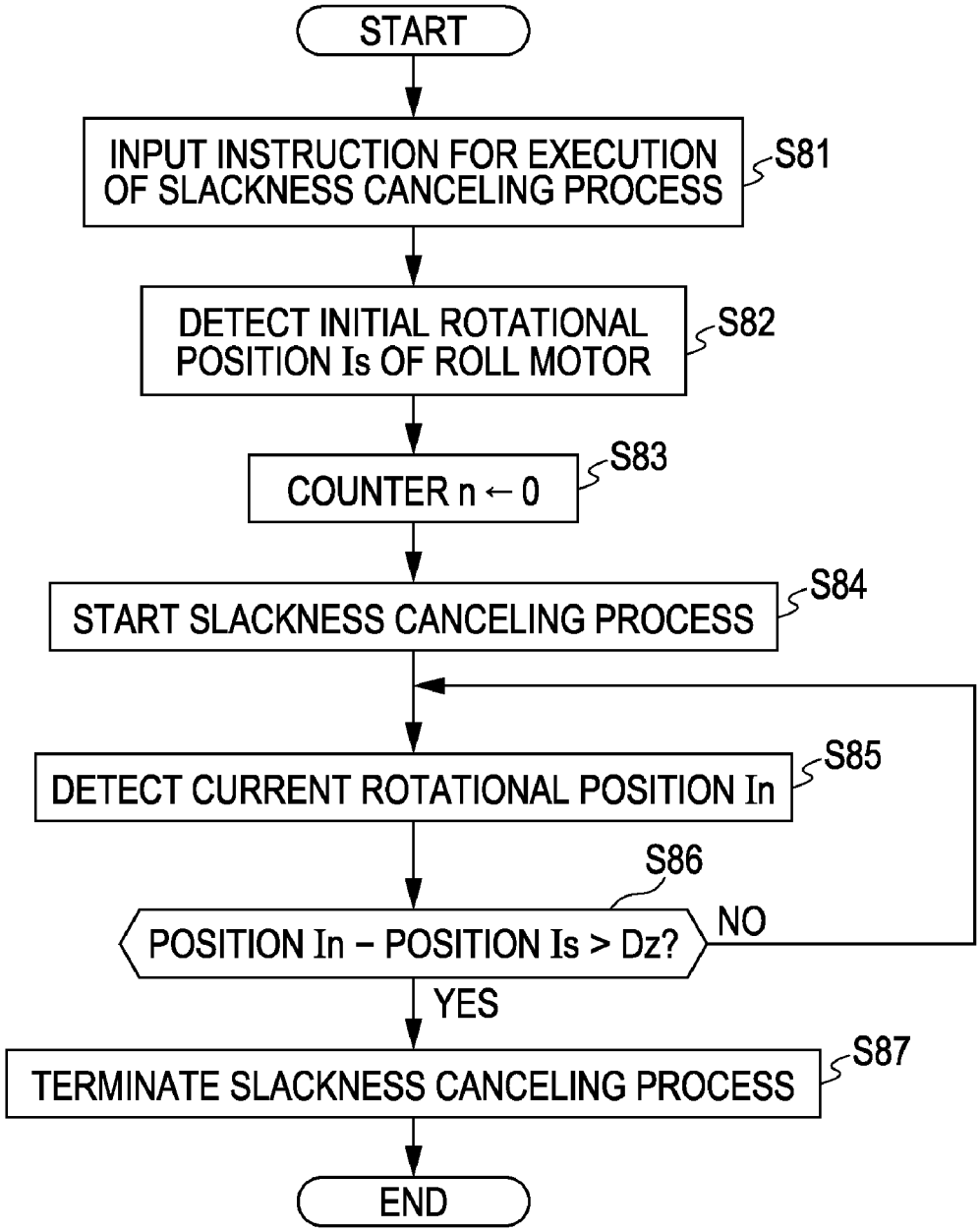
FIG. 17 is a flowchart for explaining an action of a slackness canceling unit in FIG. 16.

FIG. 17 is a flowchart showing a flow of an action of the slackness canceling unit 261 of the PF motor control unit 251 when performing the PF motor slackness canceling process Z2.

In Step S81, when an instruction for the execution of the PF motor slackness canceling process Z2 is entered from the main control unit 110, the slackness canceling unit 261 of the PF motor control unit 251 detects the rotational position of the roll motor 33 at this time in Step S82 (hereinafter, referred to as an initial rotational position Is).

At this time, the roll motor 33 is not conducted with electricity, for example, to allow the roll member RP to rotate by being pulled by the paper P and hence is in the state of being capable of rotating in the direction of normal rotation in association with the PF motor 53. However, since the PF motor slackness canceling process Z2 is not started yet and hence the PF motor 53 is not driven, the roll motor 33 is in a state of standstill. In other words, an output from the rotary sensor 34*b* when the roll motor 33 is in the state of standstill is obtained here.

In Step S83, the slackness canceling unit 261 initializes the value of the counter n to 0.

In Step S84, the slackness canceling unit 261 controls the PID calculating unit 121 to start the PF motor slackness canceling process Z2. Consequently, the rotation of the PF motor 53 in the direction of normal rotation is started by the PID control, so that the transport of the paper P in the feeding direction at the predetermined velocity is started.

In Step S85, the slackness canceling unit 261 detects the current rotational position of the roll motor 33 (hereinafter, referred to as current rotational position In). More specifically, the slackness canceling unit 261 references the signal of the rotary sensor 34*b*, and detects the current rotational position In of the roll motor 33.

In Step S86, the slackness canceling unit 261 calculates the difference between the current rotational position In detected in Step S85 and the initial rotational position Is detected in Step S82 (that is, the amount of rotation), determines whether the result is larger than the threshold value Dz ((In−Is) >threshold value Dz) or not and, if it is determined that the relation (In−Is)>threshold value Dz is not satisfied, the procedure goes back to Step S85, and the process from then onward is performed in the same manner.

When it is determined that the relation (In−Is)>threshold value Dz is satisfied in Step S86, the slackness canceling unit 261 controls the PID calculating unit 121 in Step S87, and terminates the PF motor slackness canceling process Z2.

The slackness canceling unit 261 acts as described above and the slackness of the paper P is cancelled.

When the paper feed of the paper P in the feeding direction is performed in the state in which the slackness of the paper P is cancelled, the roll motor 33 rotates by the roll member RP being pulled via the paper P.

Therefore, when the roll motor 33 that is in the state of standstill is moved in association with the PF motor 53 and is rotated by a certain amount, the slackness of the paper P is cancelled.

From the principle as described thus far, when the roll motor 33 is rotated from the state of standstill by the certain amount (Steps S82, S85, and S86), it is determined that the slackness is cancelled, and the PF motor slackness canceling process Z2 is terminated, so that the slackness of the paper P is adequately cancelled.

Backfeed of Paper P

When the roll member is set to a printer, the paper P is pulled out from the roll member and is set to the printer 10. At this time, the paper P that is pulled out is set by the user so as to enter the outer case 21, pass through the transporting roller pair 51, then pass above the platen 55, and then be pulled out from the outer case 21.

However, when the printing job is started in this state, the printing job is started in a state in which the leading edge of the paper P is projected out from the outer case 21. Then, since there exists a certain distance from the leading edge of the roll paper to the position below the printhead 44, a range on which an image cannot be formed exists on the paper P between the leading edge of the paper P to the position below the printhead 44. Therefore, a useless portion that cannot be used for printing exists on the paper P. Therefore, in order to reduce the useless portion of the paper P, the paper P is moved in the direction opposite from the feeding direction (backfeed) by the reverse rotation of the PF roller to an extent in which the leading edge of the paper P is positioned at a downstream end of the platen 55 (the left end of the platen 55 in FIG. 5).

In this manner, when the backfeed is performed by the reverse rotation of the PF roller, the slackness of the paper P is generated between the transporting roller pair 51 and the roll member RP. At this time, as a reference example, the rotation of the roll member RP in the direction to wind the paper P is started to eliminate the slackness of the paper P after having terminated the backfeed by the transporting roller pair 51, and the backfeed action is completed. At this time, in order to complete the backfeed action, a total time including the time required for the backfeed of the paper P by the transporting roller pair 51 and the time required for winding the paper P by the roll member RP is necessary. Therefore, a long time used to be required until the completion of the backfeed action.

Therefore, in order to shorten the time required for the completion of the backfeed action, a following embodiment is employed.

In this embodiment, a backfeed velocity Vpf of the paper P by the transporting roller pair 51 is set to be slower than a backfeed velocity (winding velocity) Vroll by the roll member RP. The winding action of the paper P by the roll member RP is started before the backfeed of the paper P by the transporting roller pair 51 is terminated. At this time, it is assumed that the winding action of the paper P by the roll member RP is started after a wait time wait from the start of the backfeed by the transporting roller pair 51, and a distance of the backfeed by the transporting roller pair 51 (backfeed distance) is expressed by Fd, the wait time wait is expressed by the following expression;

$$\text{Wait}=Fd/vpf-Fd/\text{vroll}.$$

For example, it is assumed that the backfeed velocity Vpf of the transporting roller pair 51 is 3 (inches/s), the backfeed velocity Vroll of the roll member RP is 4 (inches/s), and a backfeed distance Fd is 13 (inches). Then, the wait time wait is 1.08 (s) from the expression shown above. The time required by the transporting roller pair 51 for moving the paper P by the backfeed distance is 4.33 (s) and the time required by the roll member RP for winding the paper P by the backfeed distance is 3.25 (s).

In this case, the winding of the paper P by the roll member RP is started at 1.08 (s) after the start of the backfeed by the transporting roller pair 51. Then, the backfeed action by the transporting roller pair 51 and the roll member RP is terminated at 4.30 (s) after the start of the backfeed by the transporting roller pair 51. In this embodiment, the drive control of the roll motor is transferred to the PID control described above after the completion of the backfeed action.

In this configuration, in this embodiment, the backfeed action may be completed at 4.30 (s) after starting the backfeed action. This means that the time required for the backfeed is shortened by the employment of this embodiment in comparison with the method in the reference example described above in which 4.33 (s)+3.25 (s)=7.58 (s) is required.

In this manner, the backfeed action is completed in a short time by starting the winding action by the roll member RP after the predetermined wait time from the start of the backfeed by the transporting roller pair 51. Also, generation of the slackness of the paper between the transporting roller pair 51 and the roll member RP may be prevented by the configuration in which the timing of termination of the drive of the PF motor 53 for driving the transporting roller pair 51 and that of the drive of the roll motor 33 for rotating the roll member RP are substantially matched, and the backfeed distances of the both are also equalized by using the wait time obtained by the expression shown above.

The timing to terminate the drive of the roll motor 33 may be set to be slightly delayed from the timing to terminate the drive of the PF motor 53. In this configuration, generation of the slackness of the paper P between the transporting roller pair 51 and the roll member RP is prevented.

It is also applicable to control the roll motor 33 on the basis of the above-described PID control after having terminated the drive of the PF motor 53. In this configuration, the paper is prevented from breaking by controlling the tensile force generated on the paper P between the transporting roller pair 51 and the roll member RP from becoming too large.

The radius of the roll member RP is not constant, and is changed with the usage of the paper P. In such a case, the backfeed velocity Vroll of the roll member RP may be obtained by a feedback control to detect the revolving velocity of the roll motor 33 and the radius of the roll member RP with a sequential sensor or the like and adjust the backfeed velocity acquired by the obtained revolving velocity and the radius to match the Vroll.

In the description given thus far, the term "the paper P is 'slacked' between the roll member RP and the transporting roller pair 51" refers to a case in which there exists a portion that does not generate a tensile force in the direction of transport on the paper at any position between the roll member and the transporting roller. In other words, the term "slacked" means a state in which the paper P is not maintained in a linear state, and is in a curved state when viewing the roll member RP and the transporting roller pair 51 from the side as in FIG. 5. In such a state, there exists a crimpled portion on the paper P at any position between the roll member RP and the transporting roller pair 51. Therefore, the crimples of the paper at any points between the roll member RP and the transporting roller pair 51 are eliminated adequately by using the method as in the embodiment described above.

Although an embodiment has been described thus far, such embodiment may be modified variously. Subsequently the possible modifications are described. In the embodiment described above, the motor control unit is described as being provided in the printer 10. However, the motor control unit is not limited to the case of being provided in the printer 10, and may be provided on a facsimile machine using a roll member (roll paper). Although the paper P is described as being the roll paper, a film-type member, a resin sheet, or an aluminum foil may be used as the paper P.

The control unit 100 is not limited to the above-described embodiment, and may be configured in such a manner that the control of the roll motor 33 and the PF motor 53 is performed only by the ASIC 105, the control unit 100 may be configured by combining a one-chip microcomputer in which other various peripheral devices are integrated.

In addition, although the PID control in the control unit 100 is performed on the velocity in the embodiment described above, the PID control on the position is also applicable. Also, the control of the roll motor 33 and the PF motor 53 is not limited to the PID control, and the embodiment may be applied to a PI control.

The printer 10 in the embodiment described above may be part of a multiple function machines such as a scanner machine or a copying machine. In addition, in the embodiment described above, the description is given on the printer 10 of the ink jet type. However, the printer 10 is not limited to the ink jet type printer as long as it is able to eject fluid. For example, the embodiment is applicable to various types of printers such as a gel jet type printer, a toner-type printer, or a dot-impact type printer.

The embodiment described above is intended to facilitate understanding of the invention, and is not intended to limit the teachings of the invention. The invention may be modified or improved without departing the scope of the invention, and the invention includes equivalents as a matter of course.

What is claimed is:

1. A printing apparatus comprising:

a first motor configured to provide a drive force for rotating a roll member that is a wound medium;

a second motor configured to provide a drive force for driving a transporting drive roller provided on a downstream side of the roll member along a feeding direction of the medium for transporting the medium; and a control unit configured to drive at least one of the first motor and the second motor to cancel a slackness of the medium generated between the roll member and the transporting drive roller;

wherein the control unit controls the drive of the first motor so as to provide the drive force for causing the roll member to rotate in a direction opposite from the direction of rotation for transporting the medium in the feeding direction, determines whether or not the slackness of the medium is cancelled and, when it is determined that the slackness of the medium is cancelled, terminates the drive control of the first motor; and wherein the control unit determines whether or not the slackness of the medium is cancelled on the basis of a total value of control values outputted from a proportional element, an integral element, and a derivative element in PID control with respect to the first motor and a threshold value, which is a control value in the PID control when transporting the medium at a predetermined velocity in a state in which a predetermined tension is provided between the roll member and the transporting drive roller, compares the total value and the threshold value and, when the total value exceeds the threshold value, performs a correction to change the total value to the threshold value and controls the first motor.

2. A printing apparatus comprising:

a first motor configured to provide a drive force for rotating a roll member that is a wound medium;

a second motor configured to provide a drive force for driving a transportiing drive roller provided on a downstream side of the roll member along a feeding direction of the medium for transporting the medium; and a control unit configured to drive at least one of the first motor and the second motor to cancel a slackness of the medium generated between the roll member and the transporting drive roller;

wherein the control unit controls the drive of the first motor so as to provide the drive force for causing the roll member to rotate in a direction opposite from the direction of rotation for transporting the medium in the feeding direction, determines whether or not the slackness of the medium is cancelled and, when it is determined that the slackness of the medium is cancelled, terminates the drive control of the first motor; and wherein the control unit determines whether or not the slackness of the medium is cancelled on the basis of a control value outputted from an integral element in PID control with respect to the first motor and a threshold value, which is a control value in the PID control when the medium is transported at a predetermined velocity in a state in which a predetermined tension is provided between the roll member and the transporting roller, compares the control value and the threshold value and, when the control value exceeds the threshold value, performs a correction to change the control value to the threshold value and controls the first motor.

3. A printing apparatus comprising;

a first motor configured to provide a drive force for rotating a roll member that is a wound medium;

a second motor configured to provide a drive force for driving a transporting drive roller provided on a downstream side of the roll member along a feeding direction of the medium for transporting the medium; and a control unit configured to drive at least one of the first motor and the second motor to cancel a slackness of the medium generated between the roll member and the transporting drive roller;

wherein when transporting the medium by the transporting drive roller in the direction opposite from the feeding direction, the control unit activates the first motor to cause the medium to be transported by the roll member in the opposite direction from the feeding direction after having elapsed a predetermined period from the activation of the second motor to cause the medium to be transported by the transporting drive roller in the direction opposite from the feeding direction and when the second motor is still in operation.

4. The printing apparatus according to claim 3, wherein the control unit controls the drive of the first motor so as to provide the drive force for causing the roll member to rotate in a direction opposite from the direction of rotation for transporting the medium in the feeding direction, determines whether or not the slackness of the medium is cancelled and, when it is determined that the slackness of the medium is cancelled, terminates the drive control of the first motor.

5. The printing apparatus according to claim 3, wherein when transporting the medium by the transporting drive roller in the direction opposite from the feeding direction, the control unit terminates the drive control of the first motor after the drive control of the second motor is terminated.

6. The printing apparatus according to claim 3, wherein when transporting the medium by the transporting drive roller in the direction opposite from the feeding direction, the control unit controls the first motor and the second motor so as to make the transporting velocity of the medium by the rotation of the roll member to be faster than the transporting velocity of the medium by the rotation of the transporting drive roller.

7. The printing apparatus according to claim 3, wherein the predetermined period is obtained on the basis of the amount of transport of the medium by the transporting drive roller in the direction opposite from the feeding direction, the transporting velocity of the medium by the rotation of the roll member, and the transporting velocity of the medium by the rotation of the transporting drive roller.

* * * * *